US012013219B2

(12) United States Patent
Lindsay et al.

(10) Patent No.: US 12,013,219 B2
(45) Date of Patent: Jun. 18, 2024

(54) INERTIA BULLET REMOVER

(71) Applicant: AOB Products Company, Columbia, MO (US)

(72) Inventors: Michael Lindsay, Columbia, MO (US); Michael Cottrell, Ashland, MO (US); James Tayon, Moberly, MO (US); Timothy S. Kinney, Warrenton, MO (US); Mark Dalton, Columbia, MO (US); Brian Steere, Columbia, MO (US); Justin Burke, Columbia, MO (US); Kyle Martin, Columbia, MO (US); Dennis W. Cauley, Jr., Fayette, MO (US); Anthony Vesich, Columbia, MO (US); Ryan Varnum, Columbia, MO (US); Seth Wheeler, Columbia, MO (US); Brett Eckelkamp, Fulton, MO (US); Matthew Kinamore, Columbia, MO (US); Curtis Smith, Columbia, MO (US)

(73) Assignee: AOB Products Company, Columbia, MO (US)

( * ) Notice: Subject to any disclaimer, the term of this patent is extended or adjusted under 35 U.S.C. 154(b) by 668 days.

(21) Appl. No.: 17/104,272

(22) Filed: Nov. 25, 2020

(65) Prior Publication Data

US 2021/0156657 A1 May 27, 2021

Related U.S. Application Data

(60) Provisional application No. 62/941,431, filed on Nov. 27, 2019.

(51) Int. Cl.
*F42B 33/06* (2006.01)
*F42B 33/00* (2006.01)

(52) U.S. Cl.
CPC ..... *F42B 33/06* (2013.01); *F42B 33/001* (2013.01)

(58) Field of Classification Search
CPC ..... F42B 33/06; F42B 33/00; F42B 33/10
USPC ..... 86/24, 43, 40, 37, 33, 28, 23
See application file for complete search history.

(56) References Cited

U.S. PATENT DOCUMENTS

| | | | | |
|---|---|---|---|---|
| 3,898,908 A * | 8/1975 | Isenhower | ..... | F42B 33/06 86/44 |
| 4,028,989 A * | 6/1977 | Vassallo | ..... | F42B 33/06 86/49 |
| 2016/0076865 A1* | 3/2016 | Ramí Porté | ..... | F42B 33/06 86/49 |

OTHER PUBLICATIONS

Photos of Frankford Arsenal Quick-N-EZ Bullet Puller, 6 pages.
Screenshots of Video "RCBS Bullet Puller vs Hornady Cam Lock Bullet Puller", Video posted to YouTube Mar. 20, 2017, https://www.youtube.com/watch?v=McRLPrPoBXI, 5 pages.

* cited by examiner

*Primary Examiner* — John Cooper
(74) *Attorney, Agent, or Firm* — Stinson LLP

(57) ABSTRACT

An inertia bullet remover and associated methods for removing a bullet from an ammunition casing. The inertia bullet remover includes a carriage for carrying the ammunition casing. The carriage is movable with respect to a base between a first position and a second position. Movement of the carriage is guided by a guide. Movement of the carriage is stopped by a stop, which causes the bullet to exit the ammunition casing via inertia.

41 Claims, 24 Drawing Sheets

INERTIA BULLET REMOVER

CROSS-REFERENCE TO RELATED APPLICATION

The present application claims priority to U.S. Provisional Patent Application Ser. No. 62/941,431, filed Nov. 27, 2019, which is hereby incorporated by reference in its entirety.

FIELD

The present disclosure generally relates to ammunition equipment, and more particularly to an inertia bullet remover for removing a bullet from an ammunition casing.

BACKGROUND

For various reasons, a person may desire to remove a bullet from an ammunition casing. For example, the person may desire to break down or disassemble an ammunition cartridge if it was determined to have been loaded improperly (e.g., wrong load of powder, incorrect bullet, etc.).

SUMMARY

In one aspect, an inertia bullet remover is for removing a bullet from an ammunition casing. The inertia bullet remover comprises a frame and a carriage configured to carry the ammunition casing. The carriage is supported by the frame and movable with respect to the frame between a first position and a second position. The inertia bullet remover includes a guide supported by the frame and arranged to guide movement of the carriage between the first and second positions. A stop surface is arranged to stop movement of the carriage with respect to the frame in the second position. A carriage driver supported by the frame is arranged to force the carriage away from the first position toward the second position to cause the stop surface to stop movement of the carriage to cause the bullet via inertia to exit the ammunition casing carried by the carriage.

In another aspect, a method is for removing a bullet from an ammunition casing. The method comprises moving a carriage carrying the ammunition casing along a track from a first position to a second position; and stopping movement of the carriage in the second position to cause the bullet to exit the ammunition casing via inertia.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
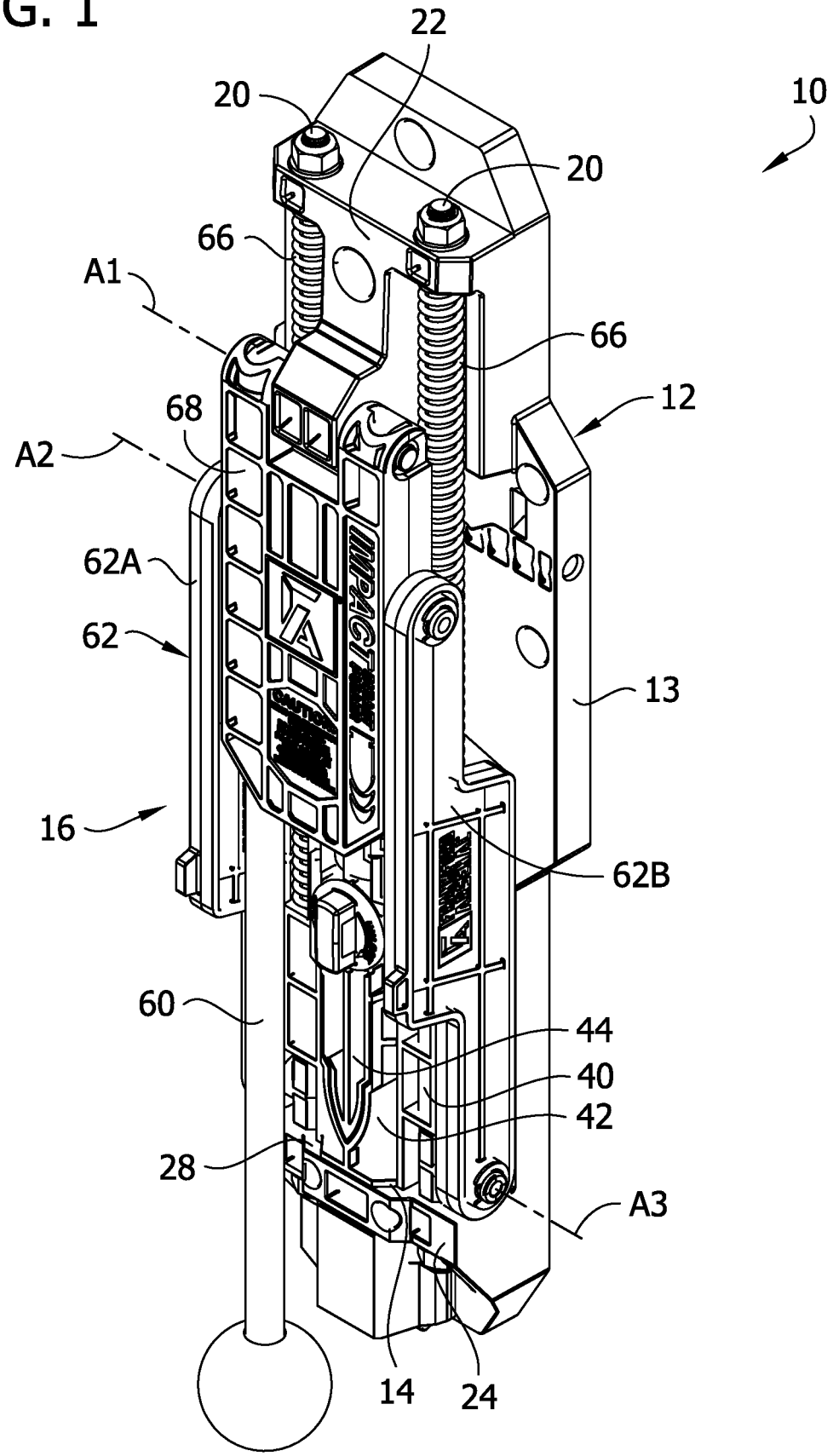
FIG. 1 is a front perspective of an inertia bullet remover of the present disclosure.

Referring to FIG. 1, an inertia bullet remover of the present disclosure is indicated generally by the reference number 10. As will become apparent, the remover 10 is configured to remove a bullet from a case or shell (broadly, "ammunition casing") of a firearm cartridge. The remover 10 removes the bullet by moving the cartridge rapidly and then suddenly stopping the cartridge while holding the case such that inertia causes the bullet and powder from inside the case to exit the mouth of the case.

The remover 10 includes a base 12, a carriage 14, and a carriage driver 16 for driving movement of the carriage with respect to the base. Using any one or more of fastener holes 18, the remover 10 can be mounted (e.g., in a vertical orientation) by fasteners to any suitable structure, such as a wall or a reloading bench. It will be appreciated that bullet removers may configured to operate in any other orientation without departing from the scope of this disclosure.

Figure 6:
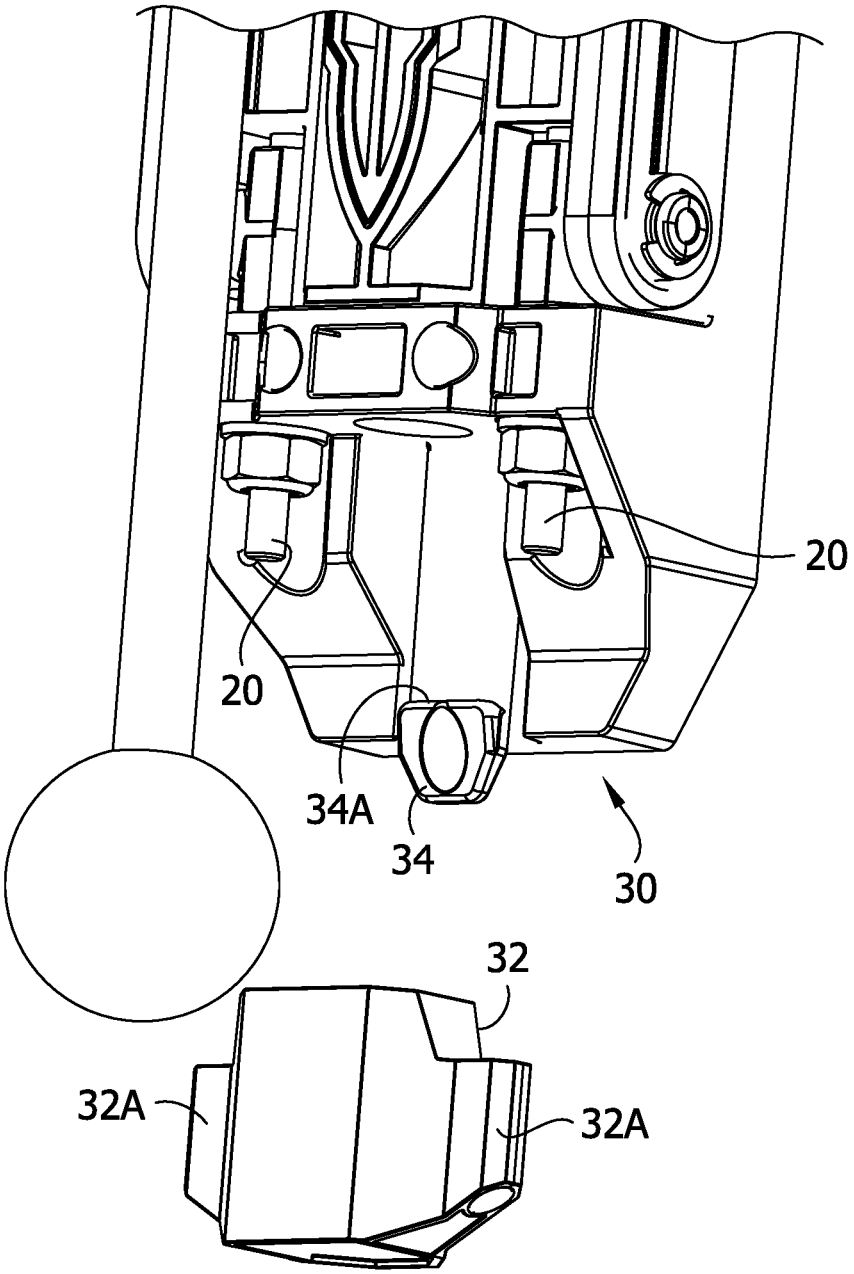
FIG. 6 is a view similar to FIG. 5 but showing a container removed from a container holder.

The base 12 includes a frame 13 and a track (broadly, "guide") on which the carriage 14 is movable. In the illustrated embodiment, the track comprises two rods (broadly, "rails") 20 extending from an upper rod connecting portion 22 of the frame 13 to a lower rod connecting portion 24 of the frame. The rods pass through openings in the rod connecting portions 22, 24 and are secured in position by nuts on opposite ends of the rods. The nuts on opposite ends of a rod 20 are tightened to oppose the rod connecting portions 22, 24 of the frame 13 to tension the rod and apply compression to the frame between the rod connecting portions, for reasons which will become apparent. The base 12 includes a stop 28 defining a stop surface for stopping movement of the carriage 14. The base 12 also defines a holder 30 (FIG. 6) for holding a bullet and powder container 32 (e.g., trap) arranged to catch a bullet and powder ejected from a case held by the carriage 14.

In the illustrated embodiment, the container 32 includes two sleeves 32A configured to fit over ends of the rods 20 to locate the container on the base. The base 12 includes a resiliently deflectable latch 34 configured to hold the container 32 in position. To install the container 32, the container is moved onto the ends of the rods. The container 32 pushes the latch 34 rearward, and the latch temporarily deflects and then resumes its at rest positon after the bottom of the container passes a tooth 34A of the latch. The tooth 34A supports the bottom of the container 32 to hold the container in position on the rods 20. To remove the container 32, a user presses the latch 34 rearward to permit the container to be moved off the rods 20.

The carriage 14 is configured to hold an ammunition case or shell from which a user would like to remove a bullet. The carriage 14 includes followers 40 defining openings through which the rods 20 extend. The followers 40 permit and guide movement of the carriage 14 along the rods 20 for ejecting a bullet from a shell carried by the carriage.

Figure 7:
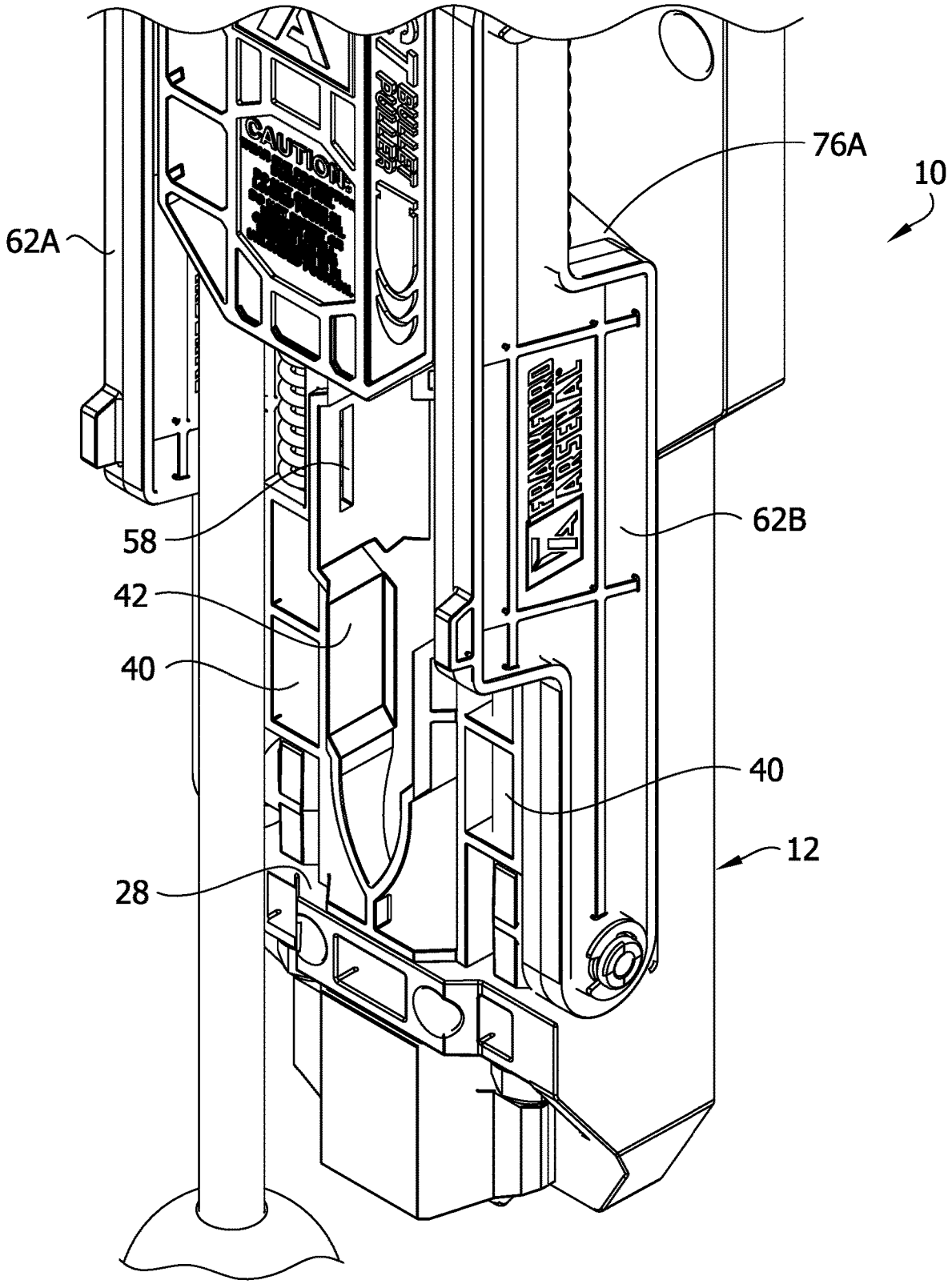
FIG. 7 is a fragmentary front perspective of the inertia bullet remover having a cartridge carrier removed from a carriage housing.
Figure 8:
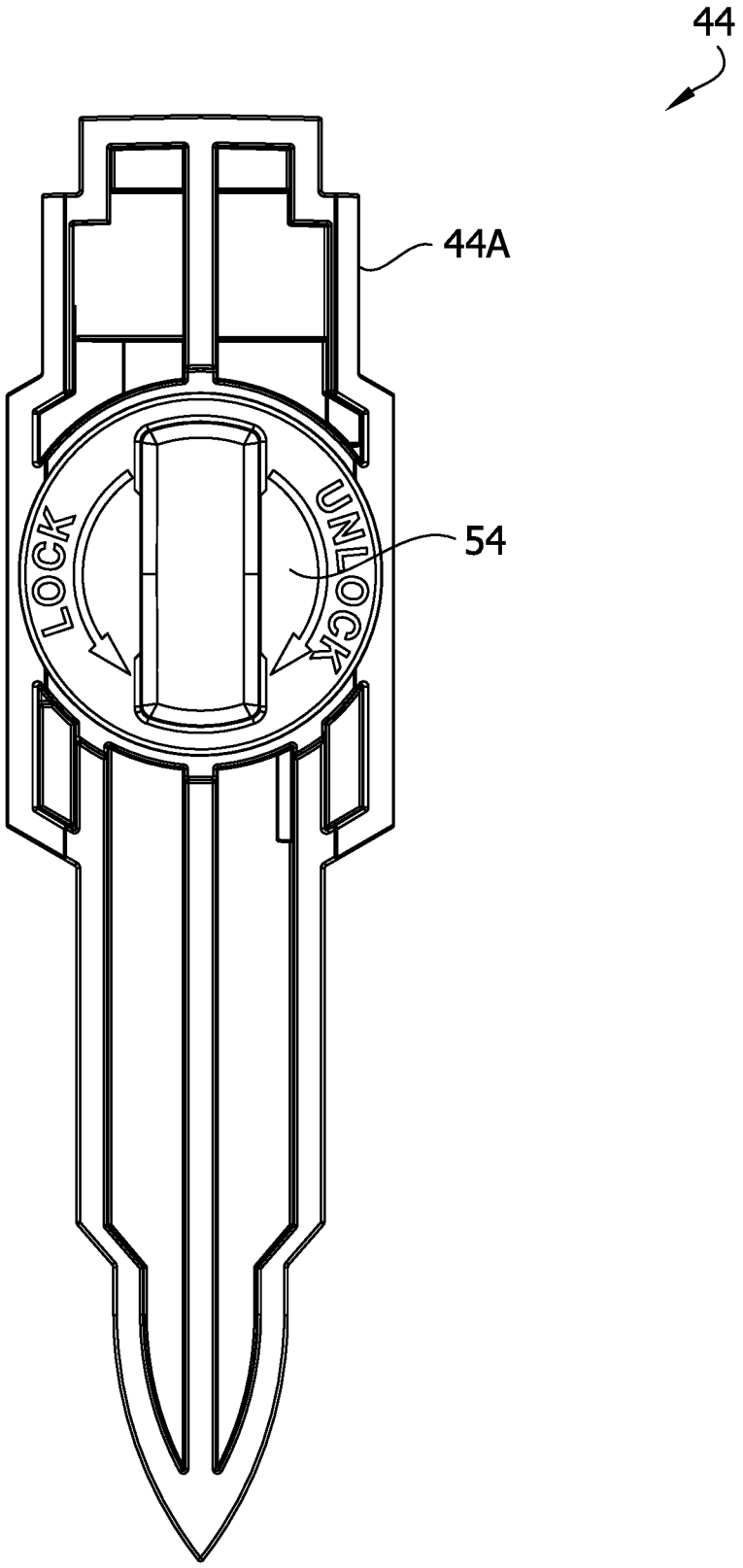
FIG. 8 is a front elevation of a cartridge carrier.
Figure 9:
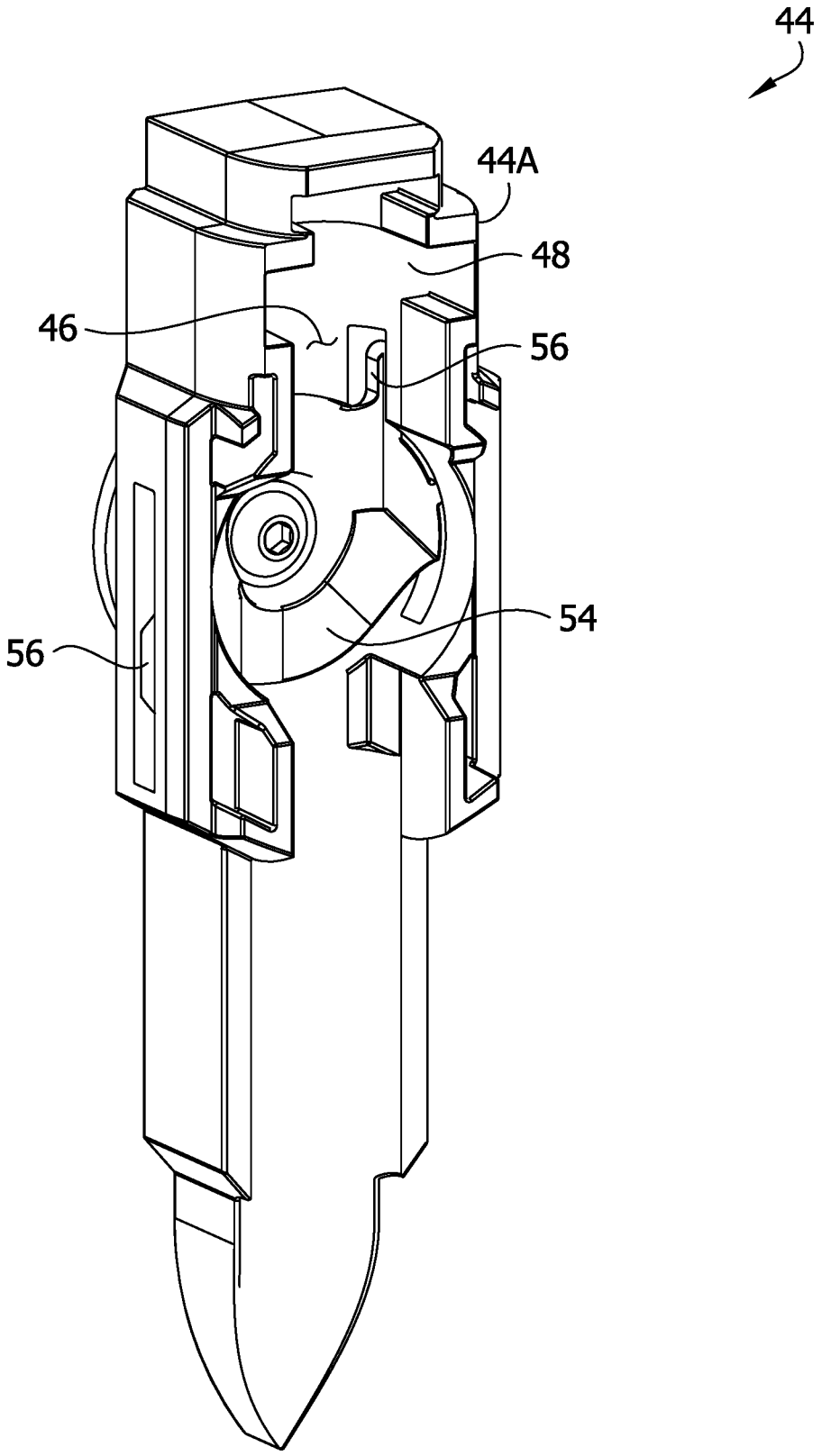
FIG. 9 is a rear perspective of the cartridge carrier.
Figure 10:
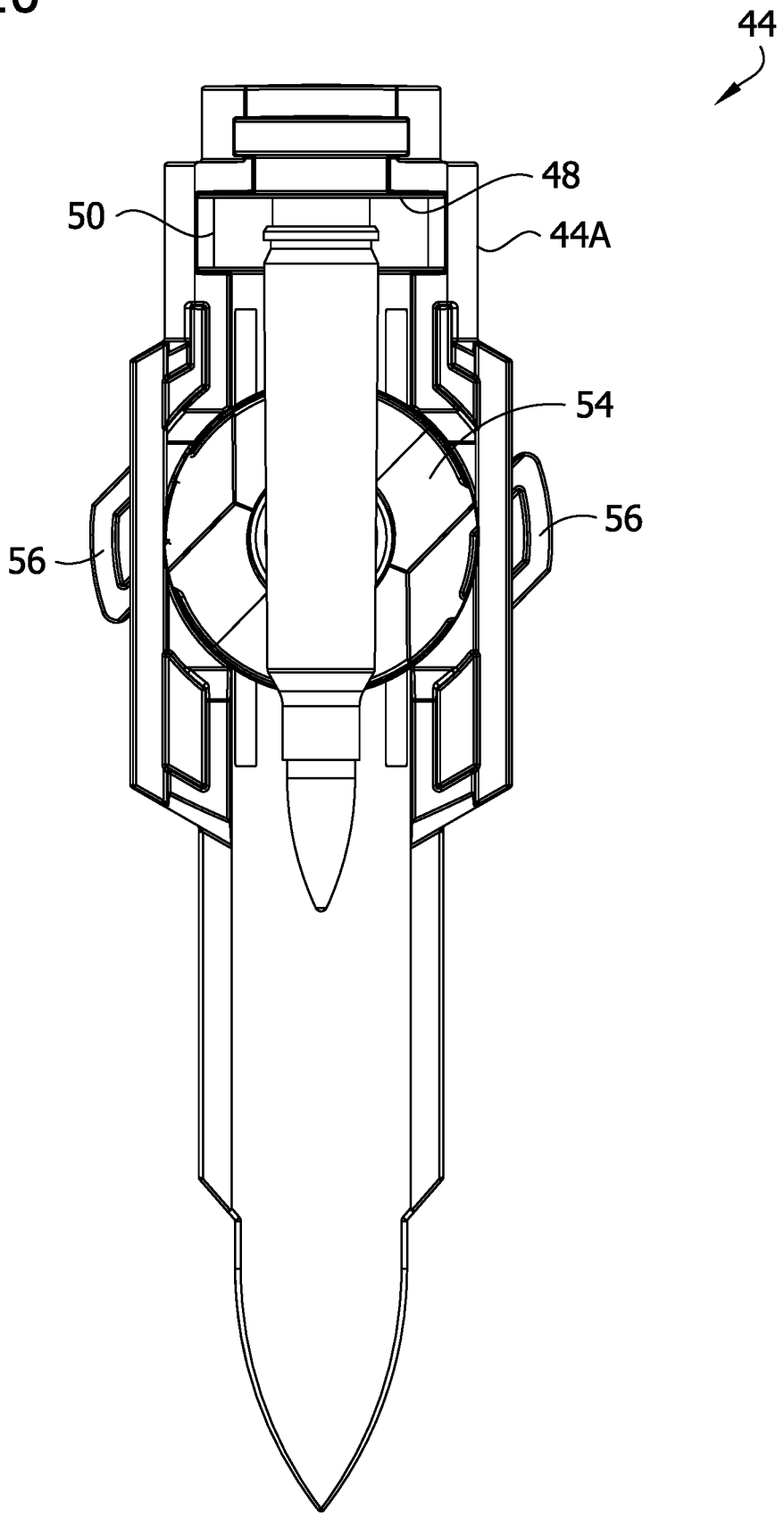
FIG. 10 is a rear elevation of the cartridge carrier.

The carriage 14 includes a carriage housing 42 on which a cartridge carrier 44 is mountable. The carriage housing 42 defines a cavity in which the carrier 44 is receivable. The carriage housing 42 includes a front opening that is closed by the carrier 44. The carrier 44 includes a carrier housing 44A defining a cartridge compartment 46 (FIG. 9) in which cartridges of different types and sizes are receivable. The carrier 44 includes a shell holder mount 48 configured to receive standard shell holders 50 (broadly, "ammunition casing holder") configured to hold different types of shells. The shell holders 50 are interchangeable on the mount 48 for adapting the remover 10 for use with different types of cartridges. As shown in FIG. 10, the shell holder 50 installed on the carrier 44 grips the shell by a flange of the shell at a primer end of the shell and holds the shell in position for conjoint movement with the carrier. A user can move a cartridge into the cartridge compartment 46 and slide the cartridge into the shell holder 50 laterally with respect to a longitudinal axis of the cartridge. In use, a cartridge is loaded in the cartridge compartment 46, and then the carrier 44 is installed in the cavity of the carriage housing 42. The carrier 44 acts as a door to close the front opening of the carriage housing 42. The carrier 44 includes a retainer 54 configured to releasably retain the carrier in position on the carriage housing 42. In the illustrated embodiment, the retainer 54 comprises an actuator (e.g., knob) and a pair of latches 56 movable into and out of slots 58 (broadly, "keepers") (FIG. 7) in the sides of the carriage housing 42 (e.g., by rotating the knob about 45 degrees in opposite first and second directions) to lock and unlock the carrier on the carriage housing.

Figure 2:
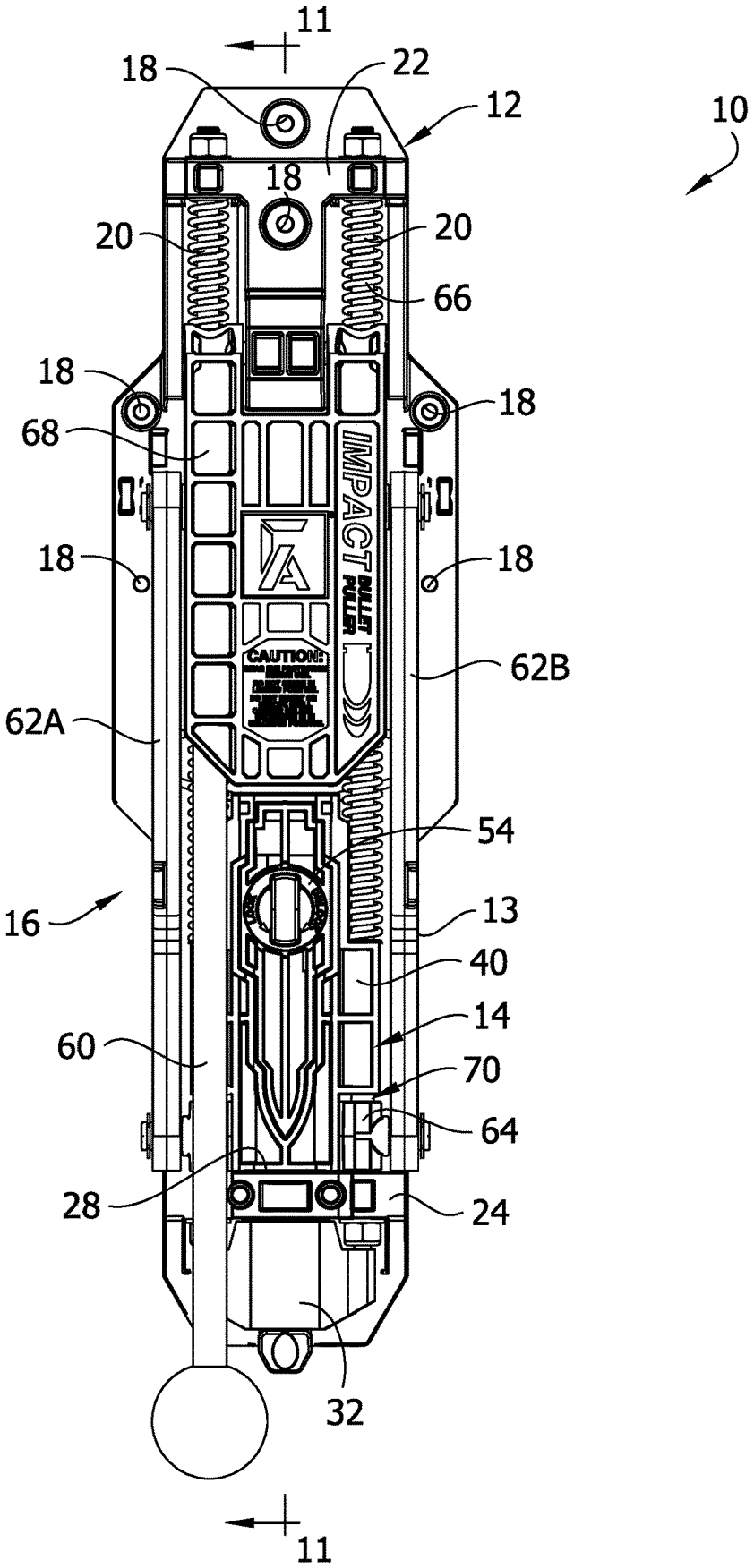
FIG. 2 is a front elevation of the inertia bullet remover.
Figure 3:
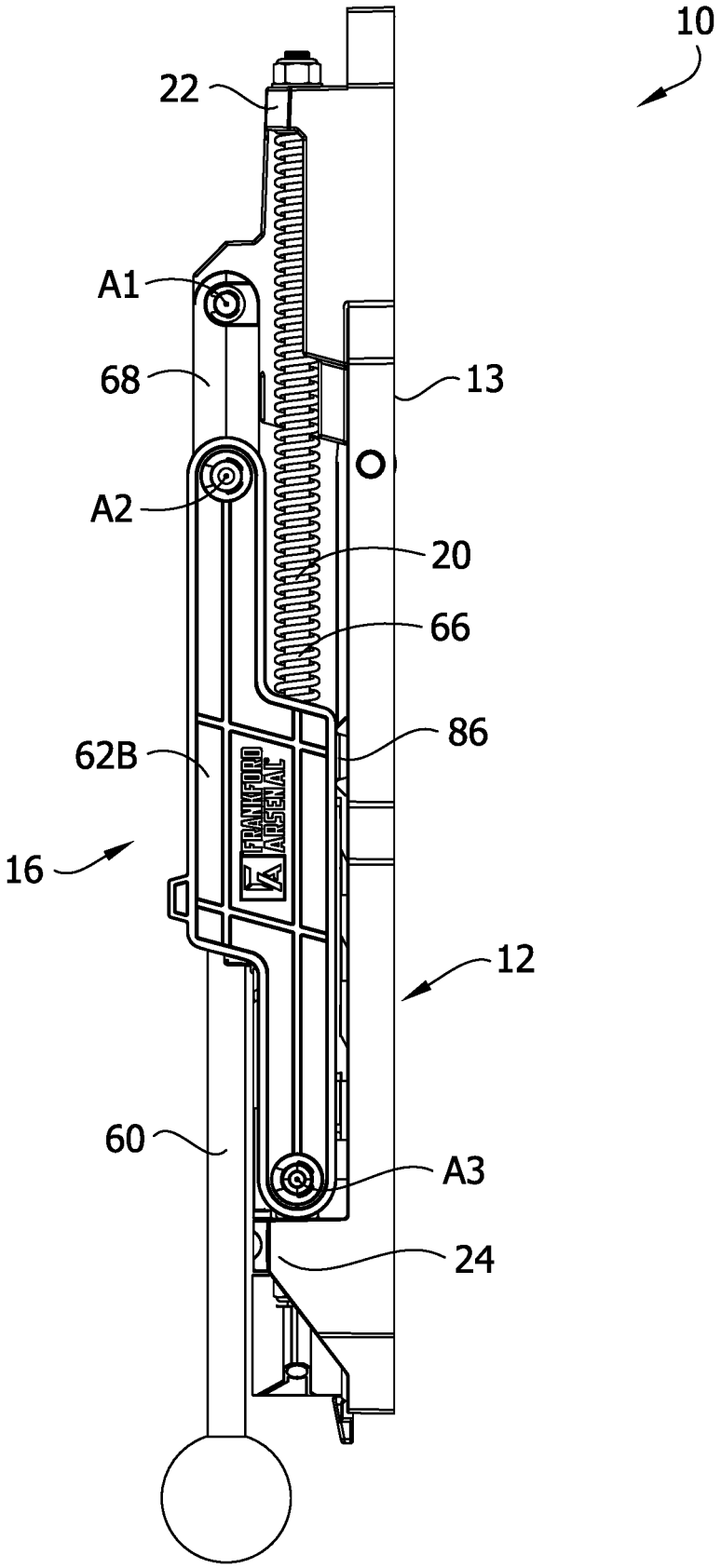
FIG. 3 is a right elevation of the inertia bullet remover.
Figure 4:
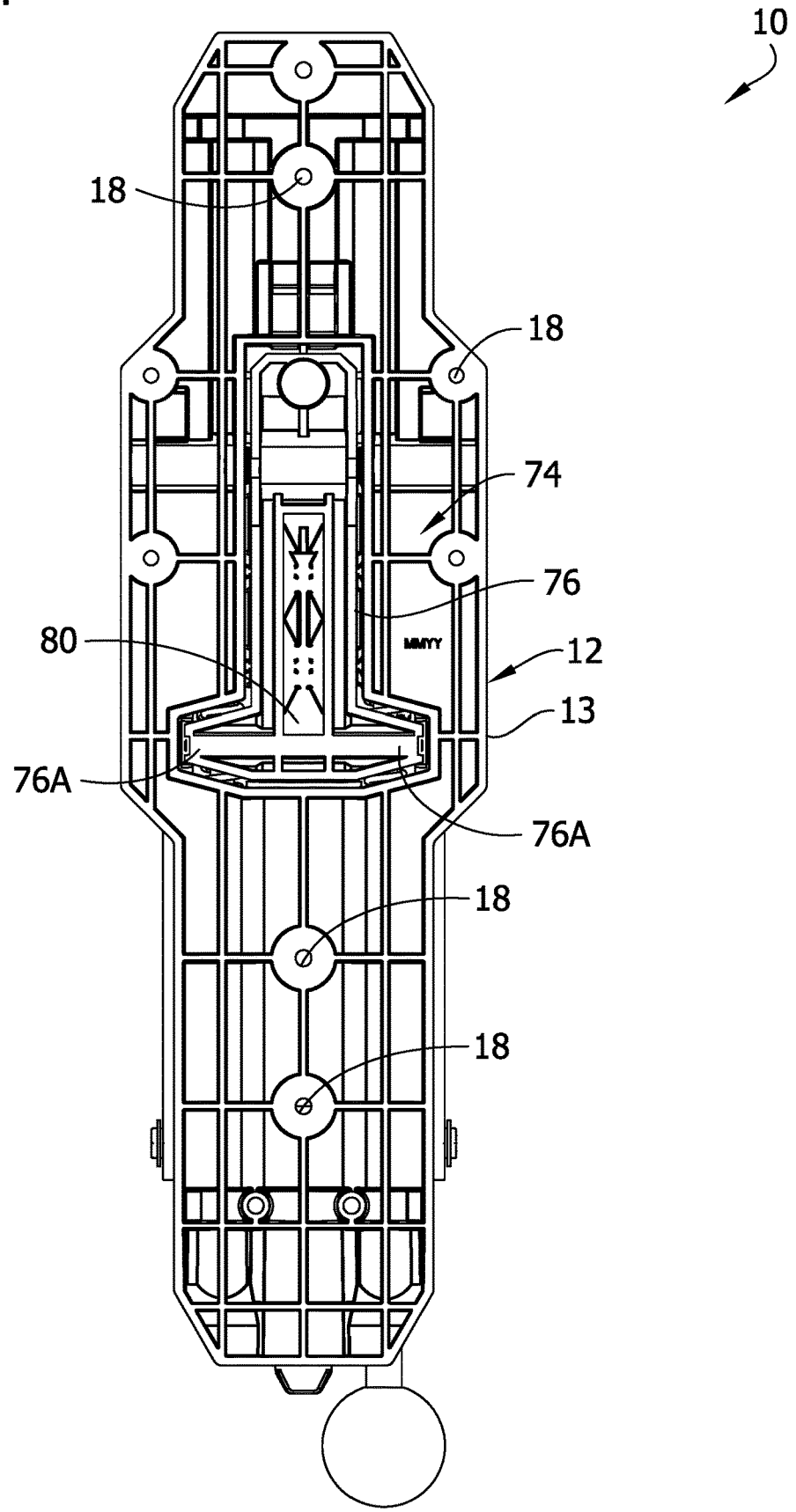
FIG. 4 is a rear elevation of the inertia bullet remover.
Figure 11:
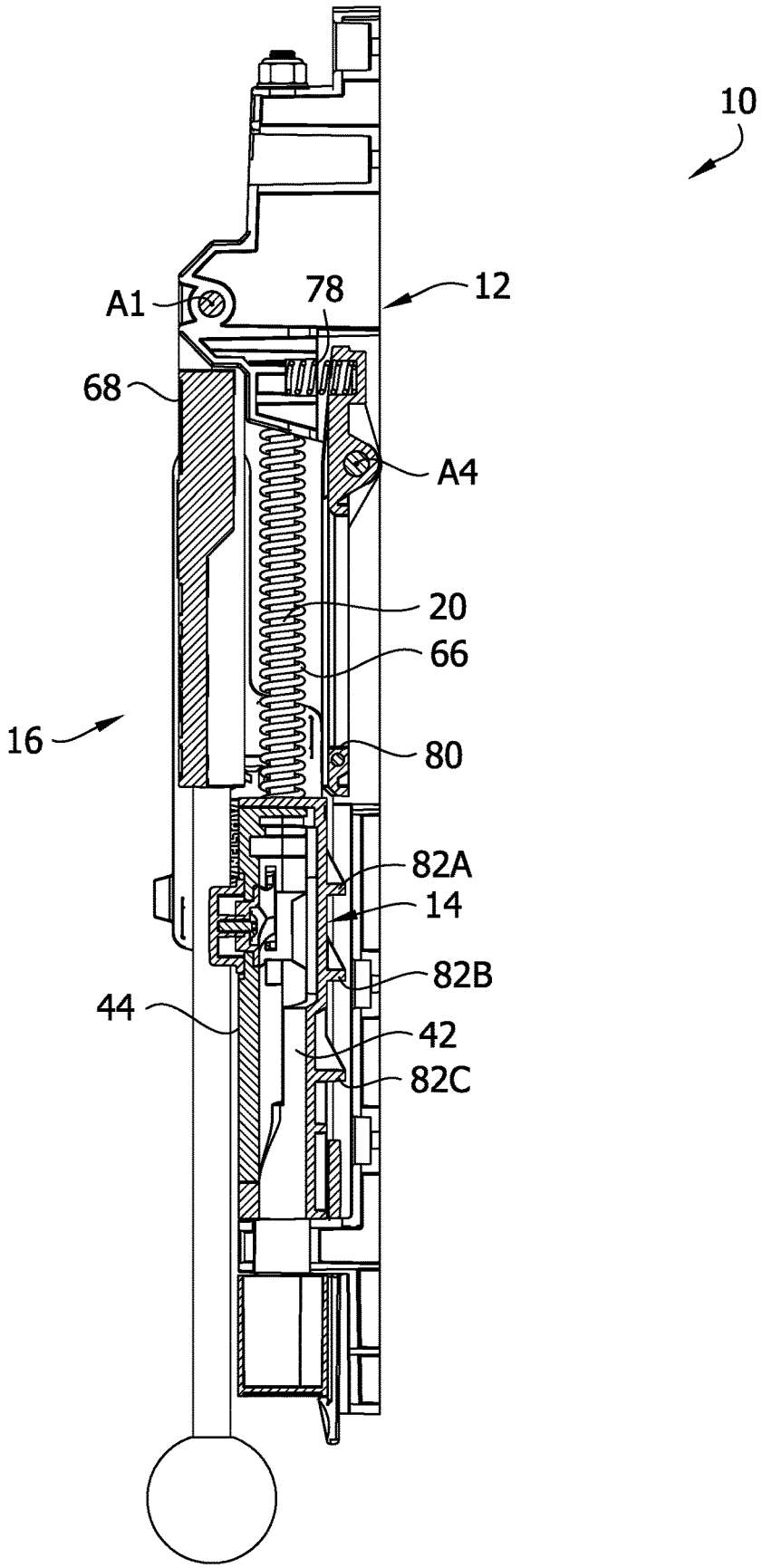
FIG. 11 is a section of the inertia bullet remover taken in a plane including line 11-11 of FIG. 2.
Figure 12:
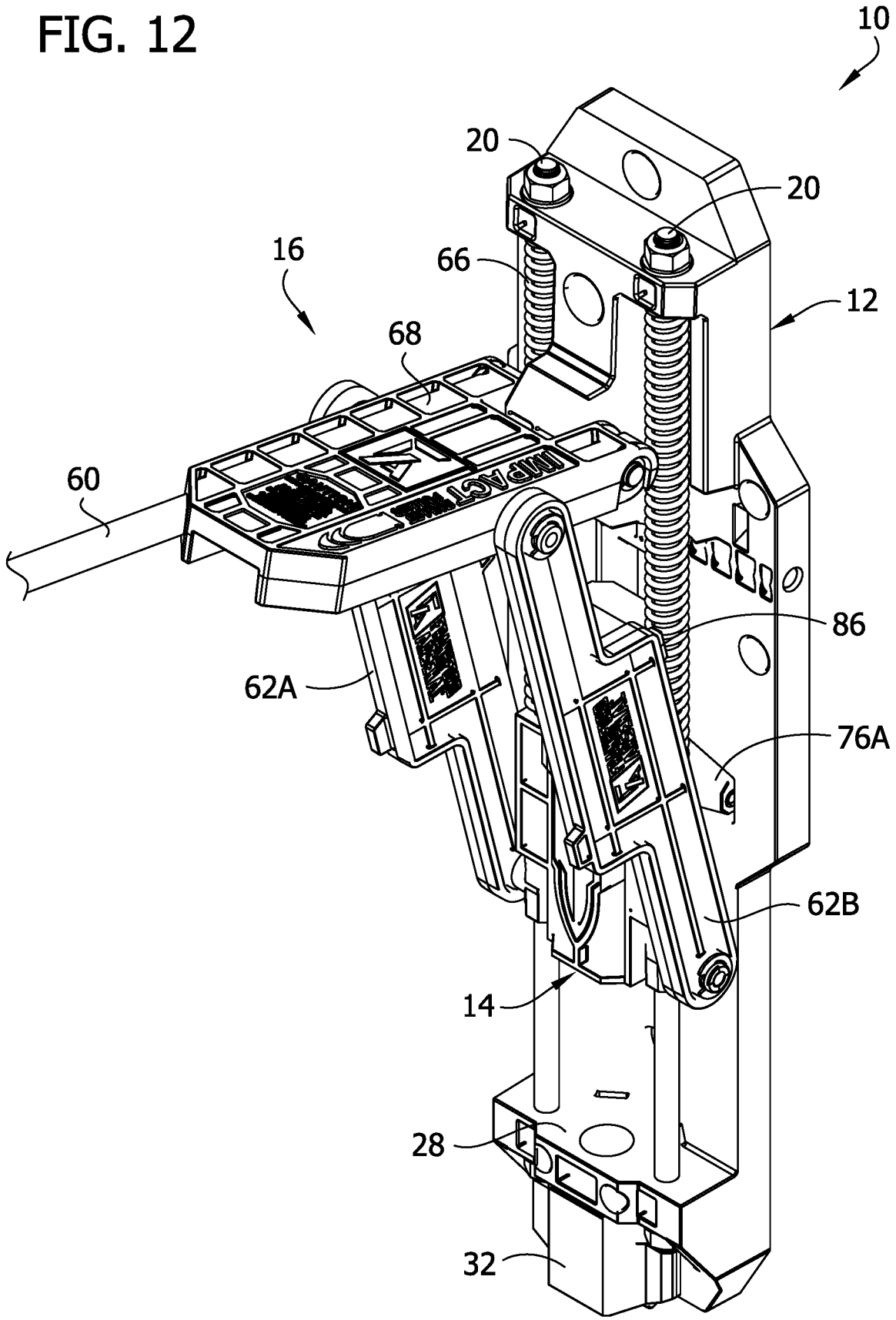
FIG. 12 is a front perspective of the inertia bullet remover having a lever moved to an actuated position for moving the carriage to a loaded position.
Figure 13:
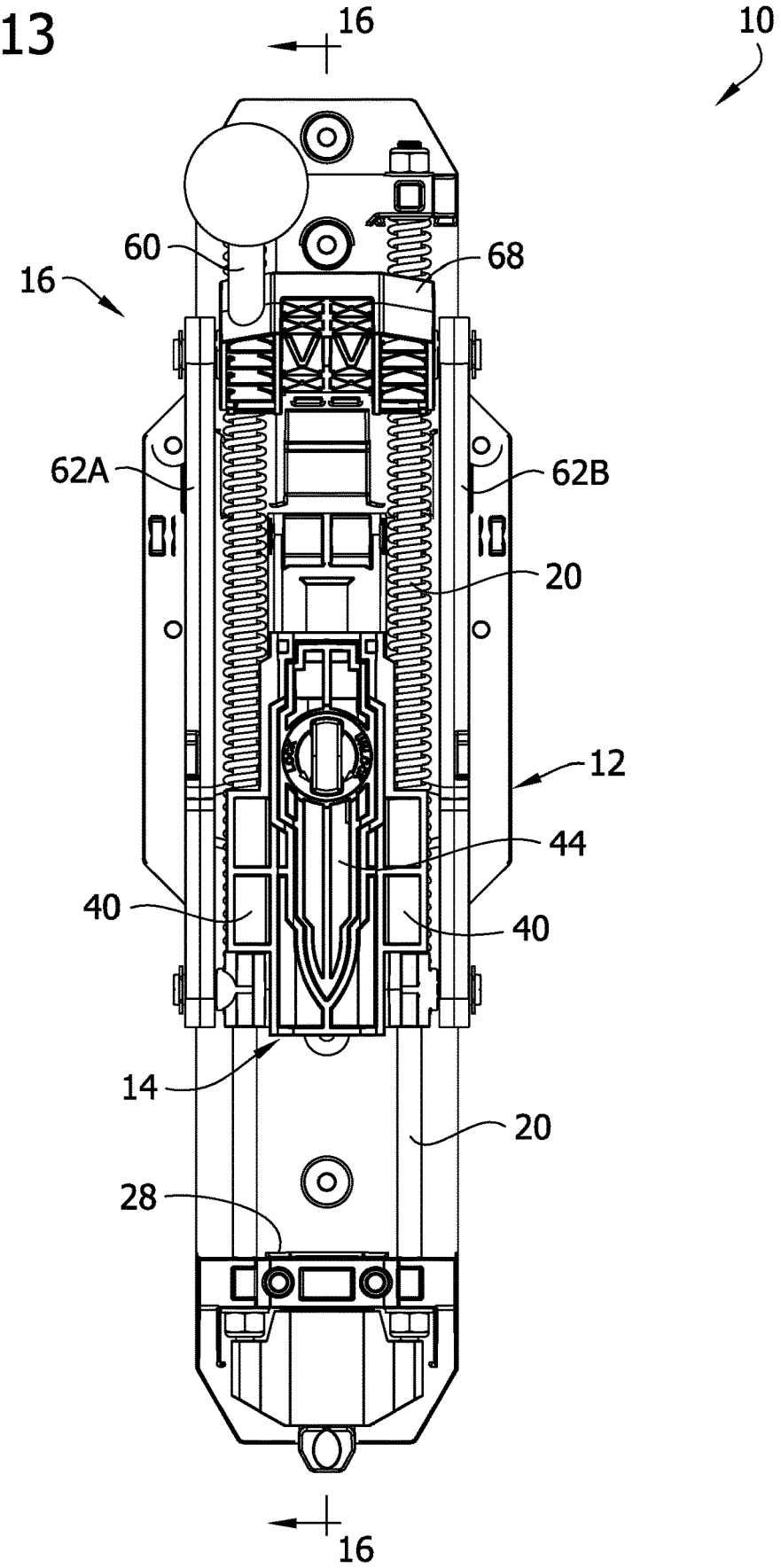
FIG. 13 is a front elevation of the inertia bullet remover in the configuration of FIG. 12.
Figure 14:
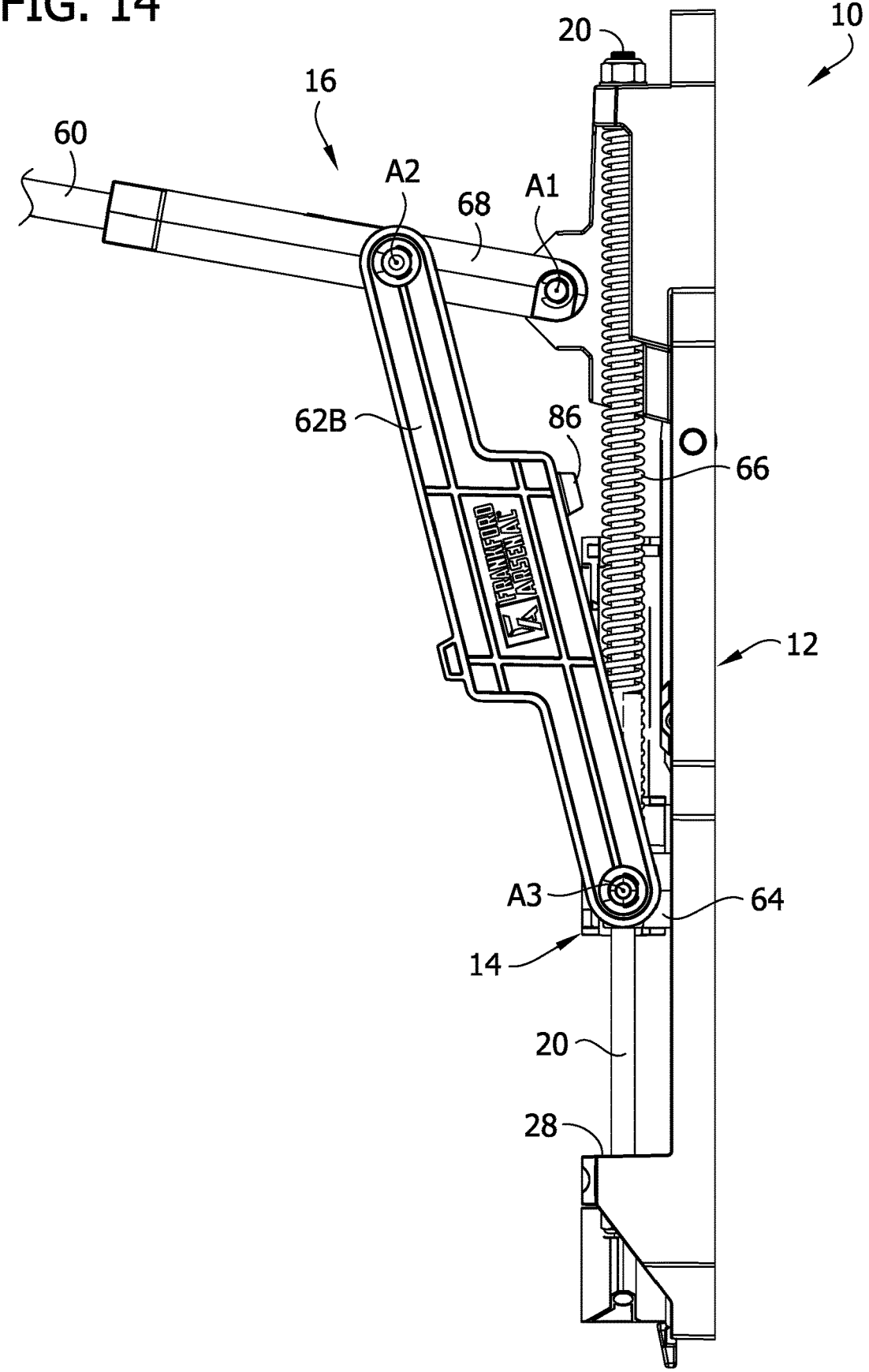
FIG. 14 is a right elevation of the inertia bullet remover in the configuration of FIG. 12.
Figure 15:
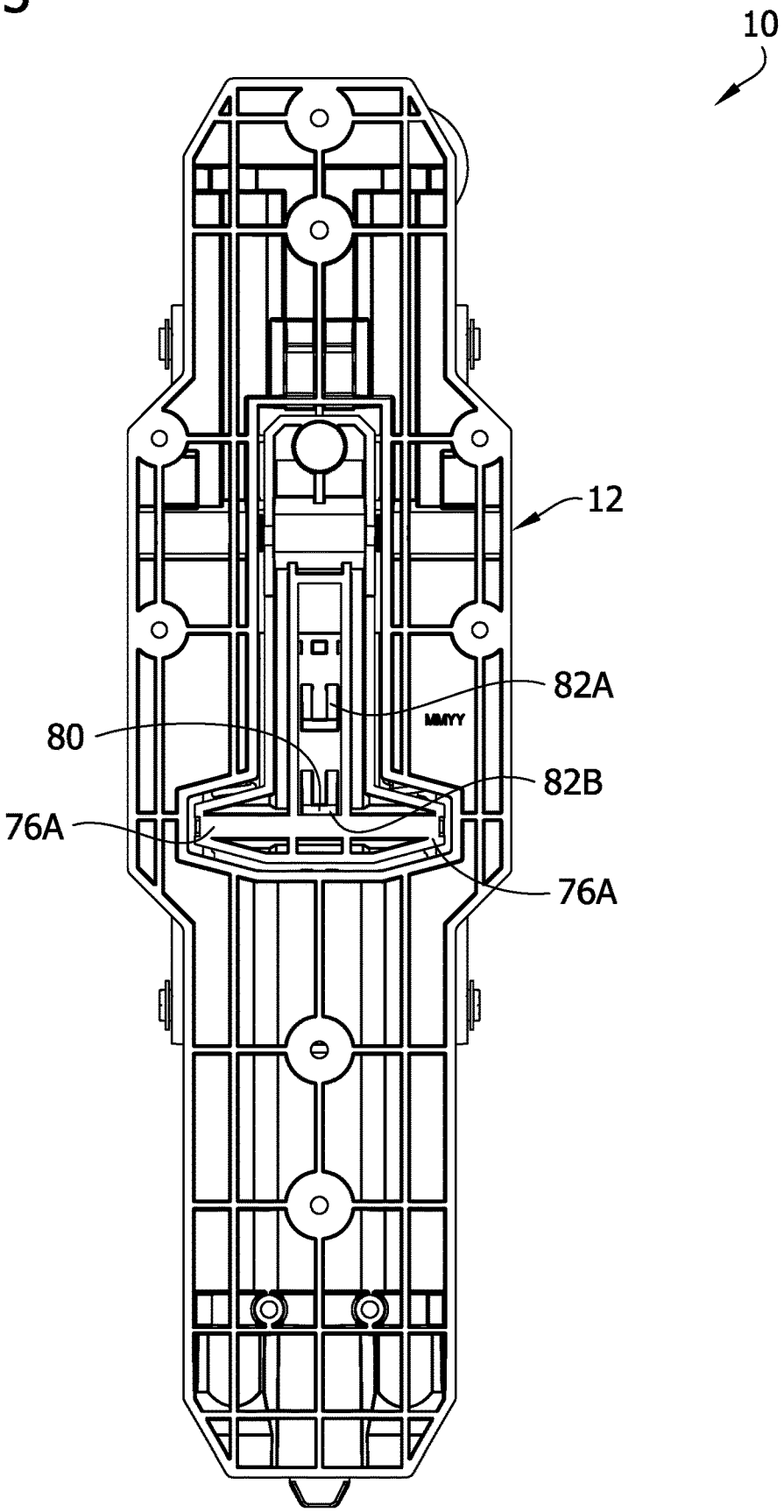
FIG. 15 is a rear elevation of the inertia bullet remover in the configuration of FIG. 12.
Figure 16:
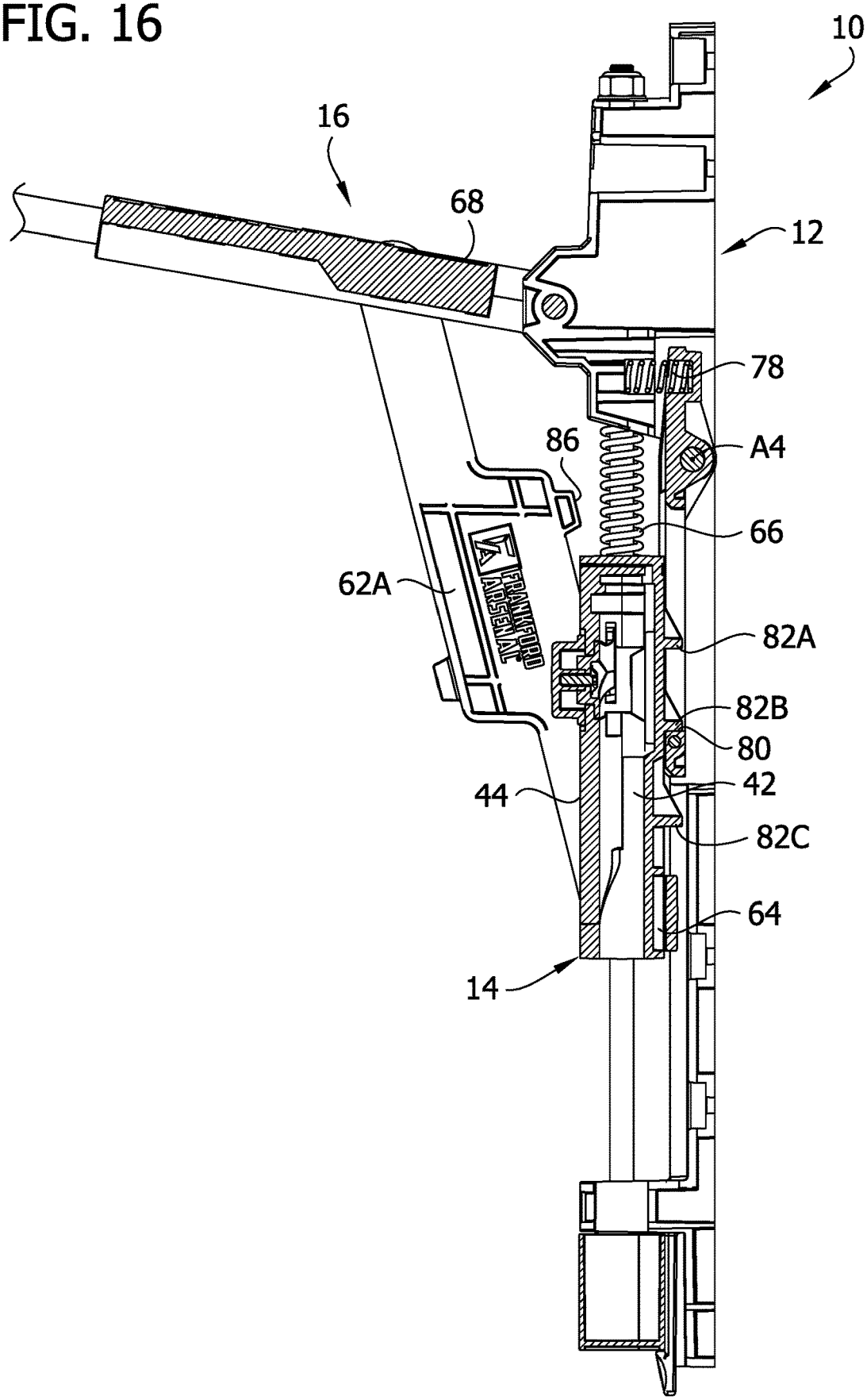
FIG. 16 is a fragmentary section of the inertia bullet remover taken in a plane including line 16-16 of FIG. 13.
Figure 17:
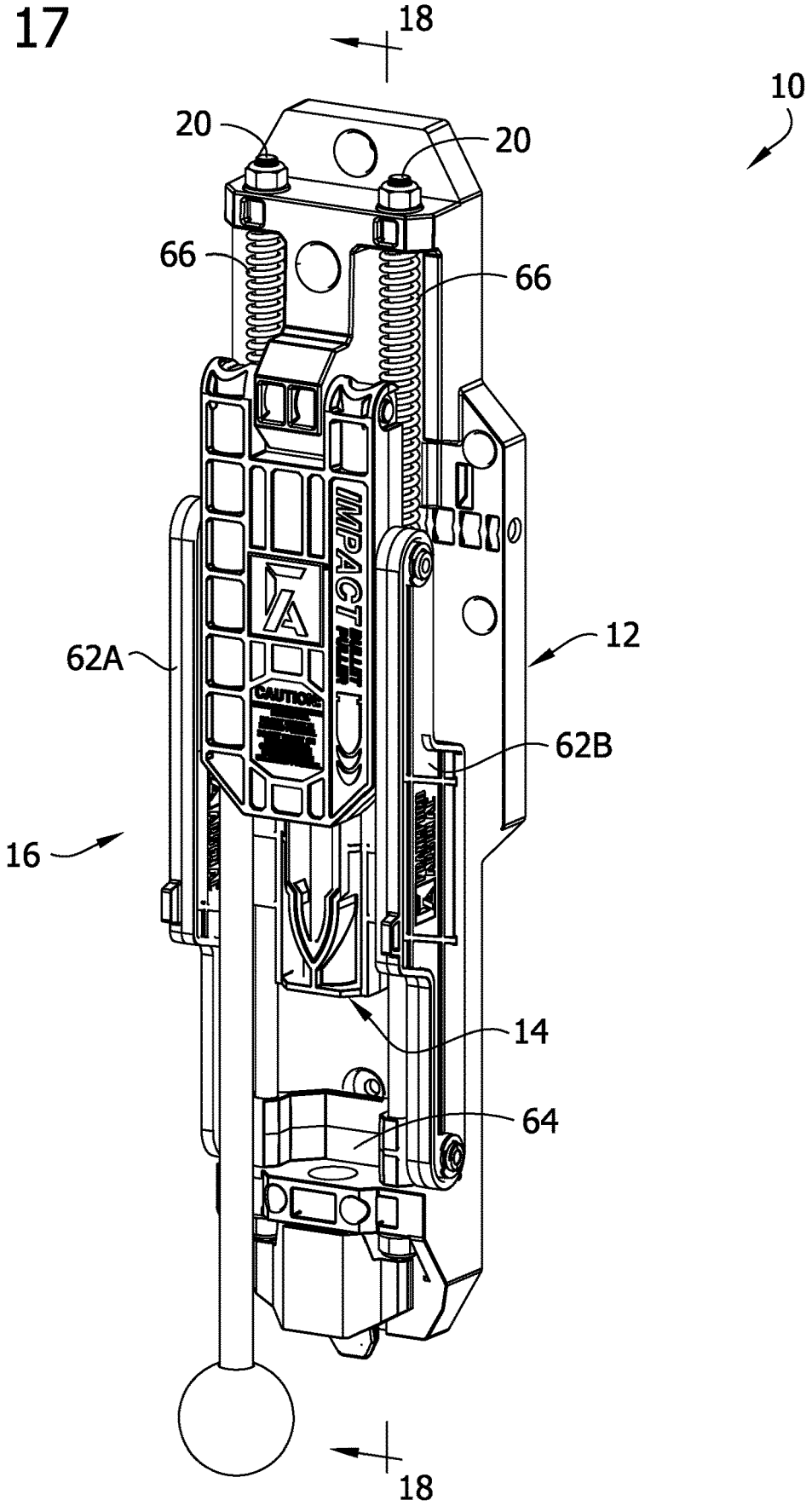
FIG. 17 is a front perspective of the inertia bullet remover having the carriage in a loaded position and the lever returned to a home position.
Figure 18:
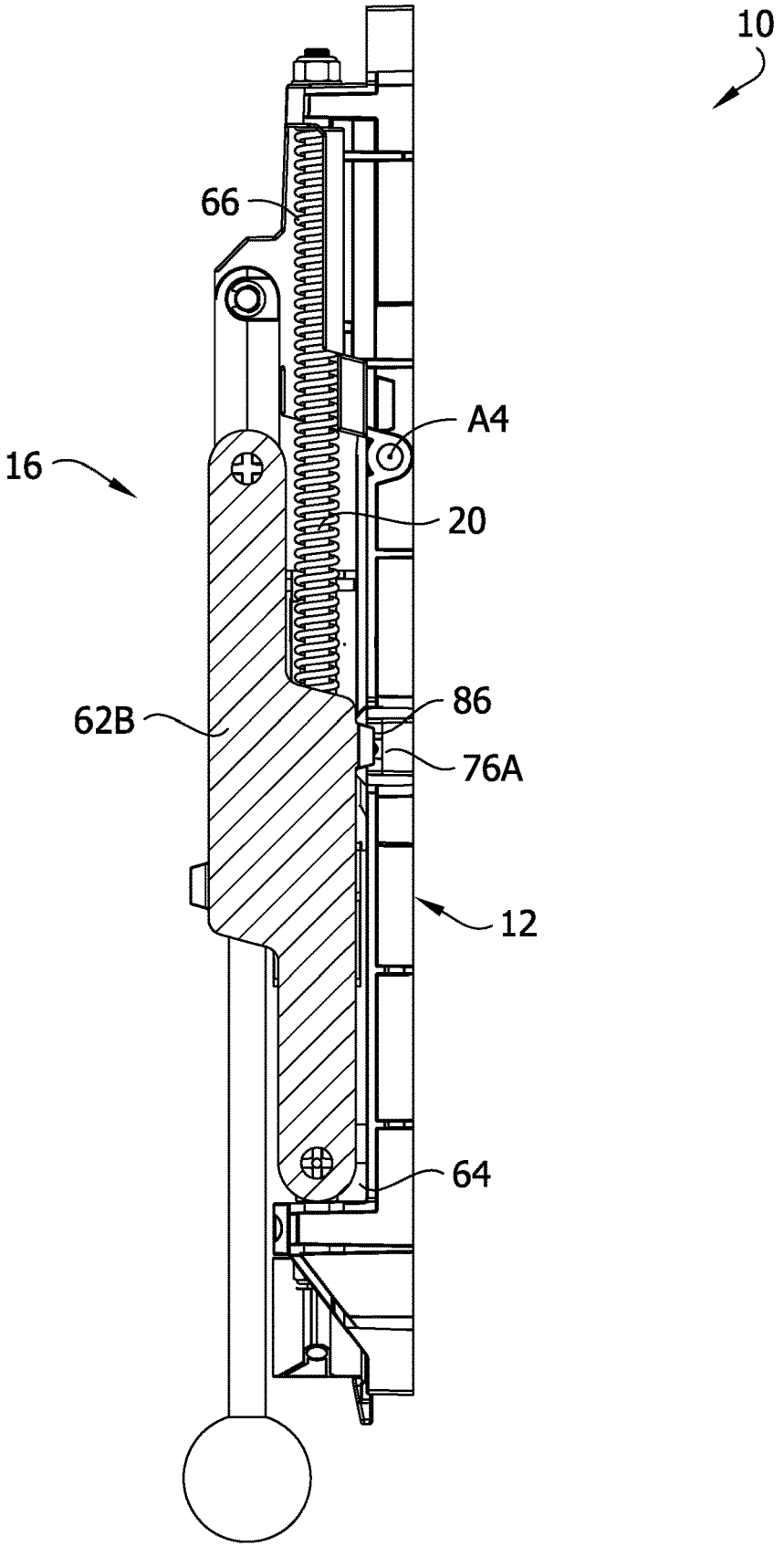
FIG. 18 is a section of the inertia bullet remover taken in a plane including line 18-18 of FIG. 17.

The carriage driver 16 is configured to move the carriage 14 from a starting positon (broadly, "second position") (e.g., FIGS. 1, 2, 11) to a loaded position (broadly, "first position") (e.g., FIGS. 12, 13, 14, 16). After the carriage 14 is moved to the loaded position, the carriage is released to move back to the starting positon. The movement of the carriage 14 toward the starting positon happens rapidly, and the carriage is stopped suddenly in the starting position, such that inertia causes the bullet and powder to leave the shell and be captured by the container 32.

Figure 5:
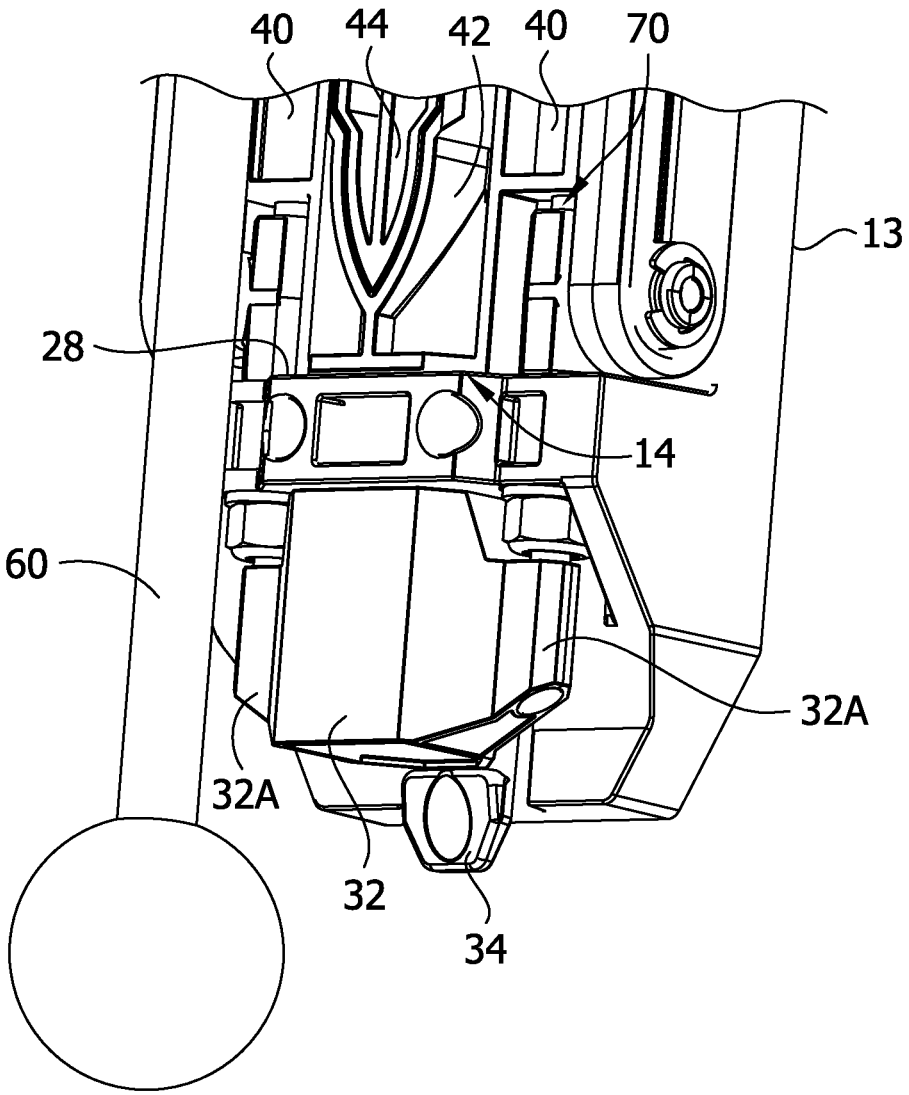
FIG. 5 is a fragmentary front perspective of the inertia bullet remover.

The cartridge driver 16 includes an actuator 60, a linkage 62, a carriage pusher 64, and a set of compression springs 66 (broadly, "biasing elements") received on the rods 20. In the illustrated embodiment, the actuator 60 comprises a lever. The lever 60 has a distal end including a knob and a proximal end connected to a lever mount 68. The lever mount 68 is pivotally connected to the base 12 to pivot about a pivot axis A1. The linkage 62 includes first and second links 62A, 62B on opposite sides of the base 12. The lever mount 68 is pivotally connected to upper (first) portions of the links 62A, 62B to pivot with respect to the links about a pivot axis A2. Lower (second) portions of the links 62A, 62B are pivotally connected to the carriage pusher 64 to pivot about a pivot axis A3. In the illustrated embodiment, the carriage pusher 64 includes two collars slidable on the rods 20 to guide movement of the carriage pusher along the rods. The arrangement is such that as the lever 60 is pivoted away from the base 12 (e.g., from a home position to an actuated position), the lever and lever mount 68 pivot about the pivot axis A1, which causes the linkage 62 to pull the carriage pusher 64 upward, to move the carriage 14 toward a loaded position of the carriage. Before the carriage pusher 64 contacts the carriage 14, the carriage pusher moves across a small clearance space 70 (e.g., 2 mm) (FIGS. 2, 5), for reasons which will become apparent. As the carriage 14 moves upward, the followers 40 of the carriage press against the springs 66 on the rods 20 and compress the springs.

The remover 10 also includes a carriage retainer 74 for retaining the carriage 14 in a loaded position prior to releasing the carriage to eject the bullet from the shell. In the illustrated embodiment, the carriage retainer 74 comprises a ratchet mechanism configured to retain the carriage in progressive loaded positions at different compression states of the springs. The ratchet mechanism comprises a lever 76 pivotable about a pivot axis A4 (FIGS. 11 and 16) and biased by a spring 78. The lever 76 has a catch 80 arranged to engage a set of teeth (broadly, "keepers") 82A-82C (three teeth in the illustrated embodiment) on a rear side of the carriage 14. The catch 80 rides on the rear of the carriage 14 and over the teeth 82A-82C as the carriage is moved upward. Each tooth 82A-82C includes a ramped surface configured to deflect the catch away from the carriage to permit the tooth to pass the catch. After a tooth 82A-82C passes the catch 80, the catch is moved by the spring 78 into retaining position with respect to a retaining surface of the tooth. If the user were to release the lever 60, the catch 80 would prevent the carriage 14 from moving back to its starting position by engaging the retaining surface of the tooth 82A-82C above the catch. It will be appreciated that different types of carriage retainers (e.g., different types of ratchet mechanisms) can be used without departing form the scope of the present disclosure. For example, a single tooth instead of multiple teeth could be used such that there is a single retained loaded position rather than progressive retained loaded positions.

The user can select the amount of compression applied to the springs 66 by the amount the lever 60 is pivoted away from its home position, and thus select the force at which the carriage 14 will be moved back to the starting position. FIGS. 12-16 show the lever 60 pivoted to drive the carriage 14 to an intermediate loaded position in which the second tooth 82B is above the catch 80. If the user desired to drive the carriage 14 to a fully loaded position (maximum spring compression), the lever would be pivoted farther upward than shown in FIGS. 12-16 to drive the lowest (third) tooth 82C above the catch 80. In other embodiments, the force at which the carriage 14 will be moved back to the starting position could be adjusted or selected in other ways (e.g., changing or adjusting a spring retainer). In still other embodiments (e.g., not having progressive retained loaded positions), the force at which the carriage 14 will be moved back to the starting position may not be adjustable.

When the user desires to release the carriage 14 to cause the bullet and powder to eject from the shell, the user pivots the lever 60 back to its home position. As the lever 60 approaches the home position, the linkage 62 moves the carriage pusher 64 back across the clearance space 70 to be out of the carriage travel path. After the cartridge pusher 64 is moved out of the carriage travel path, releases 86 in the form of protrusions on both links 62A, 62B of the linkage 62 press on wings 76A of the spring-biased lever 76 to move the catch 80 rearward to disengage the catch from the carriage 14. The teeth 82A-82C are therefore no longer blocked by the catch 80, and the springs 66 are permitted to forcefully propel the carriage 14 toward its starting position. The carriage 14 moves rapidly toward the starting position and impacts the stop 28 of the base 12 to stop the carriage in the starting position. The rods 20, in tension and applying compression to the base 12, assist in reinforcing the base and absorb force from the impact of the carriage 14 against the stop 28. The inertia of the bullet and powder causes the bullet and powder to be ejected from the shell, which is held in position on the carriage 14 by the shell holder 50. The bullet and powder move through a lower opening in the carriage, through an opening in the base, and pass into the container 32 for collecting the bullet and powder in the container. The cartridge carrier 44 closing the front opening of the carriage housing 42 prevents powder from escaping the carriage 14 except through the lower opening to the container 32. The bullet and powder can be removed from the container 32 by removing the container from the base 12 and dumping the container. The carrier 44 is removed from the carriage housing 42, the empty shell is removed from the carrier 44, and another cartridge is installed in the carrier. The process can be repeated to remove bullets and powder from additional cartridges.

Figure 20:
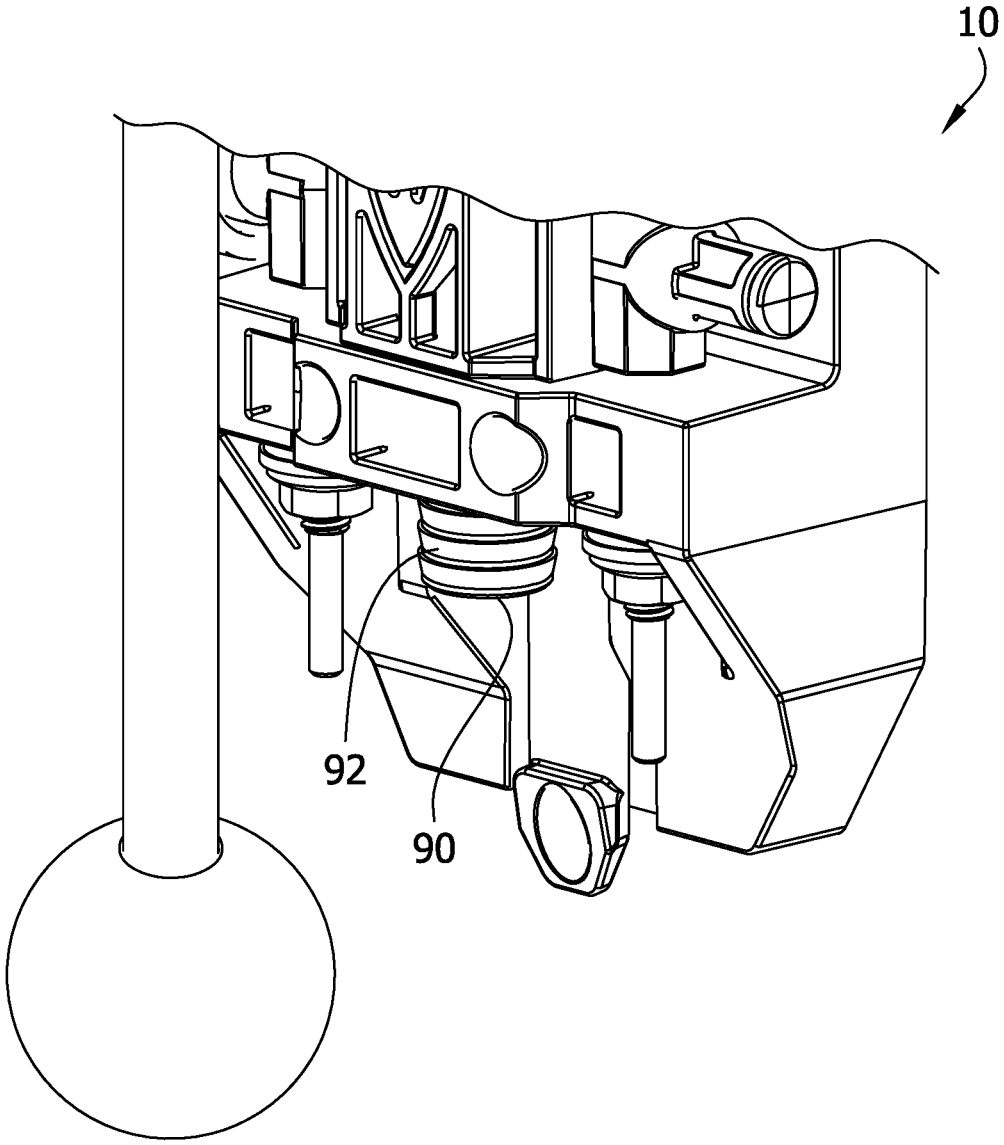
FIG. 20 is a fragmentary bottom perspective of the inertia bullet remover showing a barbed tube fitting for receiving a bullet and powder collection tube.
Figure 21:
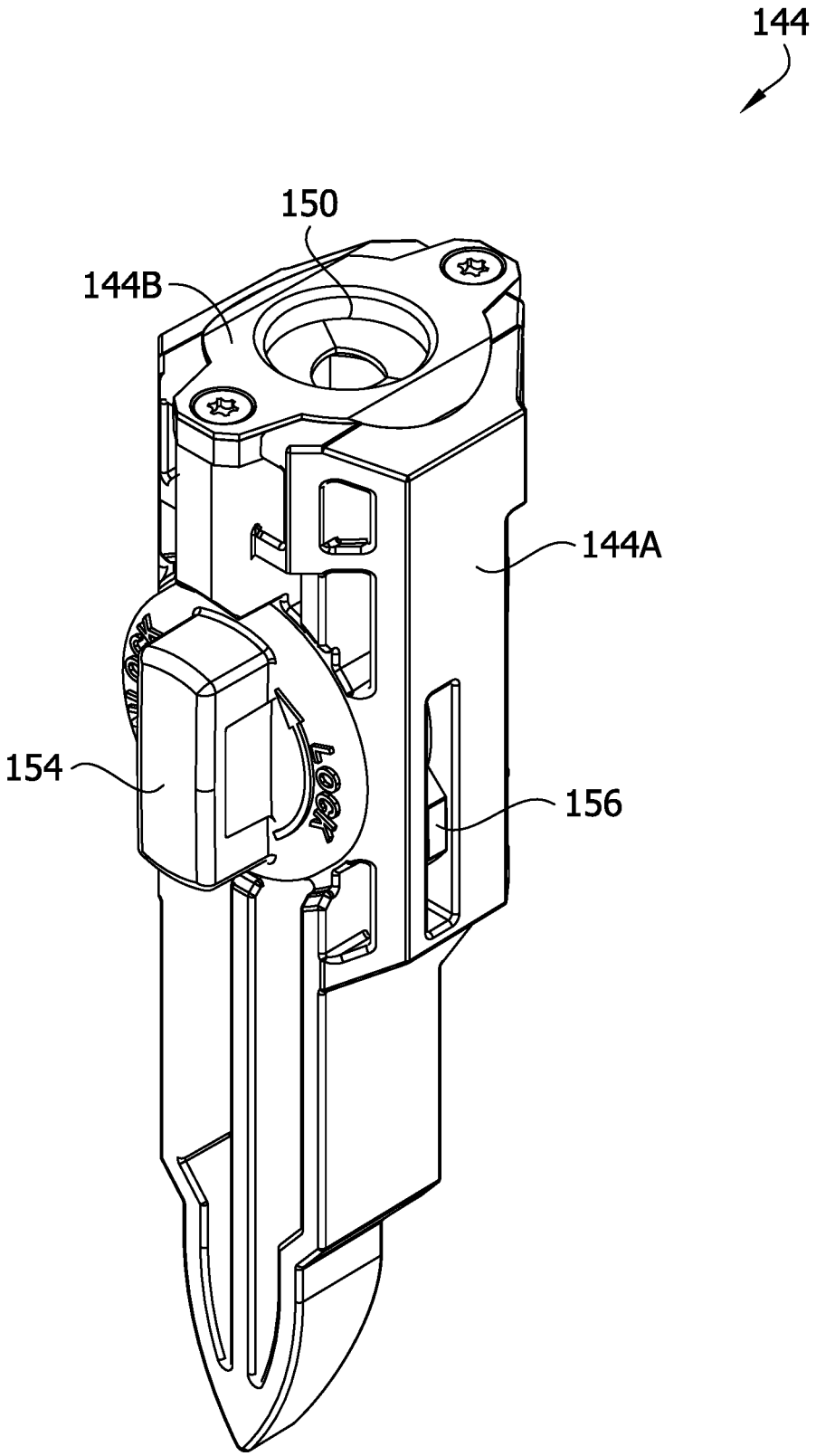
FIG. 21 is a front perspective of a second embodiment of a cartridge carrier of the present disclosure.
Figure 22:
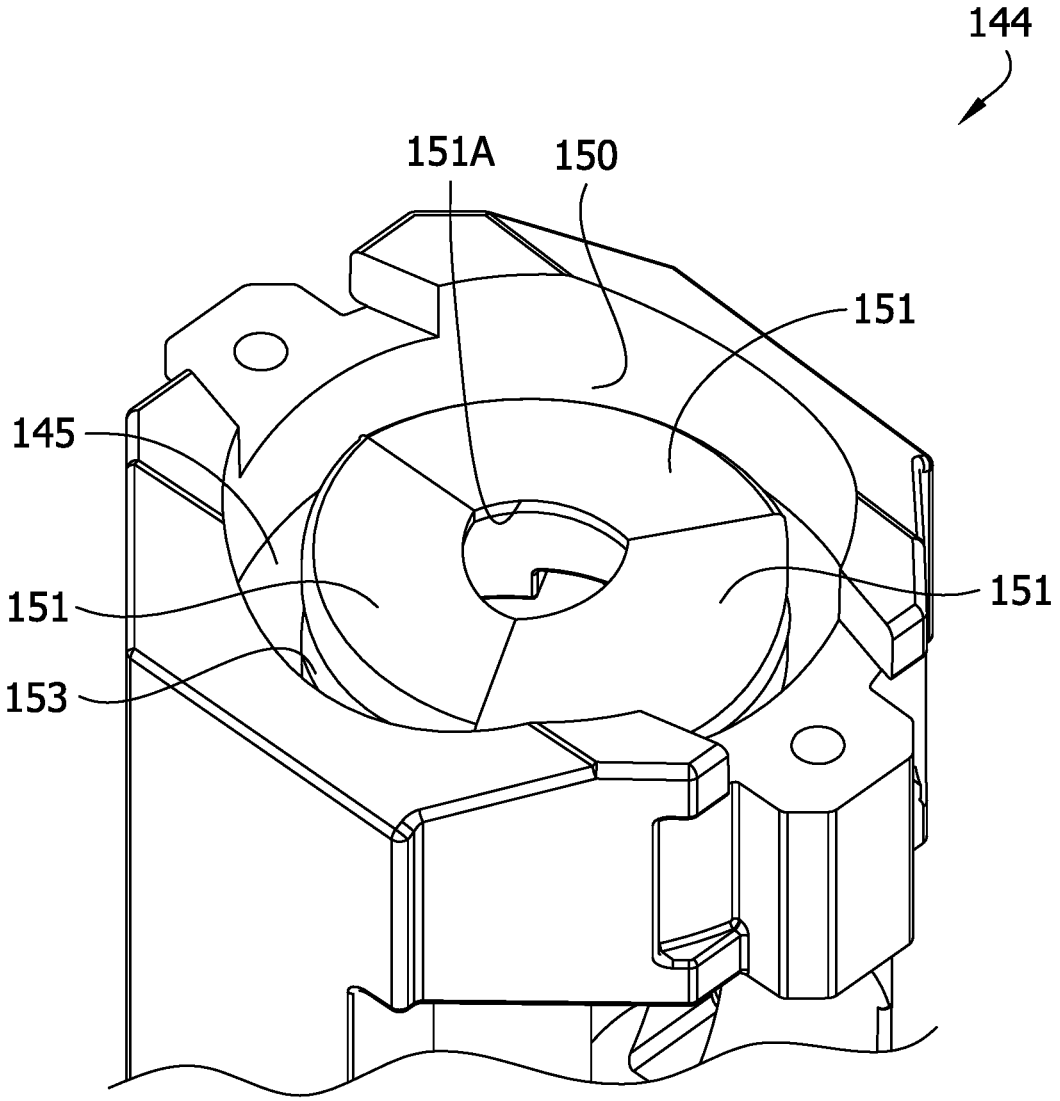
FIG. 22 is a fragmentary perspective of the cartridge carrier of FIG. 21 having a cover thereof removed to show an ammunition casing holder.
Figure 23:
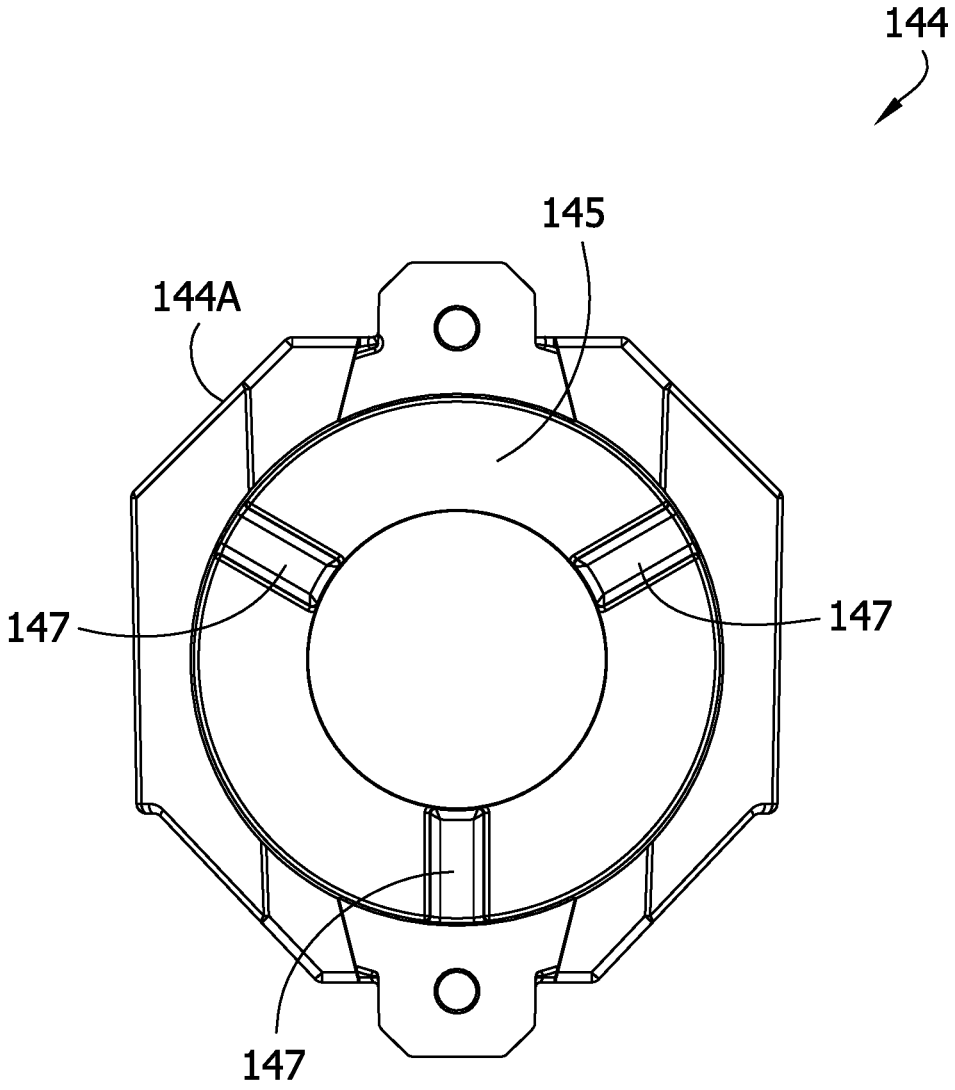
FIG. 23 is a top view of the cartridge carrier having the cover and ammunition casing holder removed.
Figure 24:
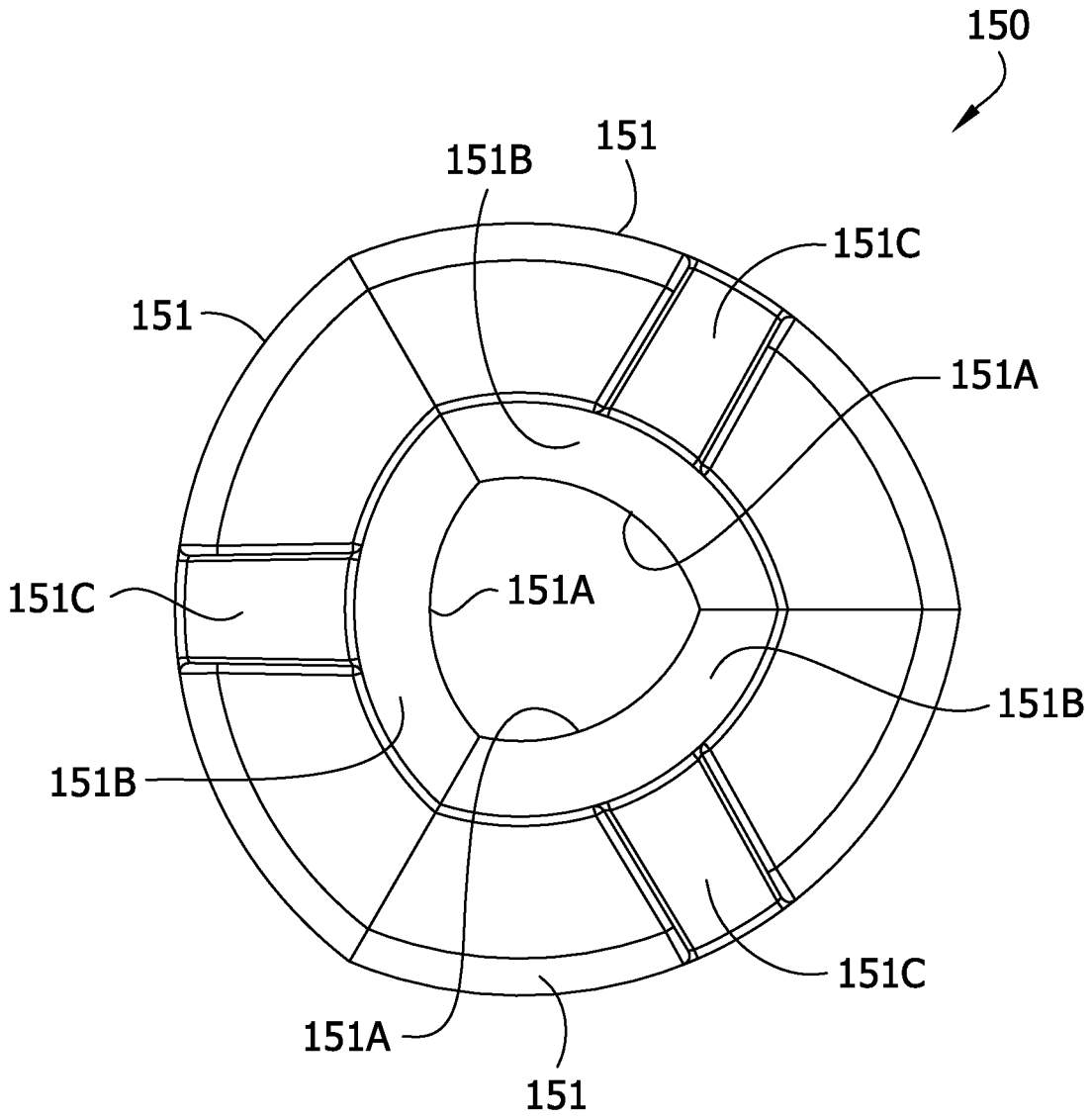
FIG. 24 is a bottom view of the ammunition casing holder.

It will be appreciated that the container 32 can be replaced by any other receptacle or series of receptacles, such as a tube or bucket, and the replacement receptacle(s) may or may not be physically attached to the remover 10, without departing from the scope of this disclosure. For example, as shown in FIG. 20, a fitting 90 is provided for connection of a tube to receive powder and bullets removed from ammunition casings by the remover 10. The fitting comprises a tubular portion sized and shaped to fit inside an end of a tube. The fitting 90 can include barbs, ribs, or other retainers 92 to engage the tube to assist in holding the tube on the fitting. It will be appreciated that a tube connected to the fitting 90 can have an outlet end located to deliver powder and bullets into a bucket or other receptacle.

It will be appreciated that the remover 10 provides spring propulsion of the carriage and a mechanical advantage in compressing the springs 66. Accordingly, users can easily generate an amount of force needed to eject a bullet from a shell. Moreover, standard shell holders can be used for holding the cartridges. The remover 10 is universal in that the remover can remove a bullet from essentially any type of ammunition cartridge with the use of an appropriate shell holder.

A second embodiment of a cartridge carrier 144 will be described with reference to FIGS. 21-24. The cartridge carrier 144 of this embodiment is very similar to the cartridge carrier 44 described above, and like reference numbers, plus 100, are used to designate like elements. For example, the cartridge carrier 144 is configured to be selectively installed on and carried by the cartridge carriage 14. The cartridge carrier 144 includes a housing 144A and a retainer 154 including a rotatable knob to move latches 156 to releasably retain the carrier on the carriage 14.

Figure 19:
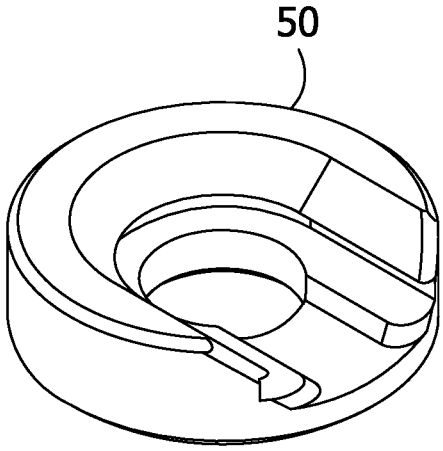
FIG. 19 is a front perspective of an ammunition casing holder usable with the inertia bullet remover.

The primary difference between the first and second embodiments of the carriers 44, 144 is the manner in which the ammunition cartridge is supported by the cartridge carrier. In the second embodiment, instead of using standard shell holders (e.g., 50 in FIGS. 10, 19), the cartridge carrier 144 includes a collet 150 configured to receive and retain ammunition casings of various sizes. The collet 150 automatically adjusts to hold the casings of various sizes. The collet 150 rests on a bed 145 defined by an upper end of the housing 144A of the cartridge carrier 144. A removable cover 144B holds the collet 150 in position on the bed 145. The collet 150 includes multiple jaws 151 movable with respect to each other to adjust the size of an ammunition casing receiving space therebetween. Each jaw 151 includes an arcuate lip 151A bounding the ammunition casing receiving space and located to be received in a groove of an ammunition casing and/or against a flange of the ammunition casing to locate the ammunition casing with respect to the cartridge carrier 144. An elastic band 153 (broadly, "biasing member") surrounds the jaws 151 and biases the jaws inwardly. The elastic band 153 permits outward movement against the bias of the band. The jaws 151 include grooves 151C that ride on ribs 147 of the housing 144A to guide inward/outward movement of the jaws and maintain the collet 150 in a centered location.

The arrangement is such that an ammunition cartridge can be installed on the cartridge carrier 144 by pushing the bullet end of the cartridge downward into the top of the cartridge receiving space. The tapered shape of the bullet causes the jaws 151 to move away from each other. The jaws 151 deflect outward and ride on the ammunition casing until the groove of the ammunition casing is moved into registration with the lips 151A of the jaws. The jaws 151 move into the groove and thus retain the ammunition casing in position with respect to the cartridge carrier 144. After the bullet is removed from the ammunition casing, the casing can be removed from the collet 150 by pushing the casing upward opposite the insertion direction. The jaws 151 include tapered lower surfaces 151B that cam on the ammunition casing to assist in spreading the jaws to permit removal of the casing. It will be appreciated that other types of collets (broadly, "ammunition casing holders") can be used without departing from the scope of the present disclosure.

It will be apparent that modifications and variations are possible without departing from the scope of the invention defined in the appended claims.

As various changes could be made in the above constructions and methods without departing from the scope of the invention, it is intended that all matter contained in the above description and shown in the accompanying drawings shall be interpreted as illustrative and not in a limiting sense.

What is claimed is:

1. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame, the carriage driver including a lever movable in an actuating direction to drive movement of the carriage away from the second position toward the first position, and the carriage driver being arranged to force the carriage away from the first position toward the second position to cause the stop surface to stop movement of the carriage to cause the bullet via inertia to exit the ammunition casing carried by the carriage.

2. An inertia bullet remover as set forth in claim 1, wherein the carriage driver comprises at least one biasing member positioned to bias the carriage toward the second position to move the carriage toward the second position.

3. An inertia bullet remover as set forth in claim 2, further comprising a carriage retainer arranged to retain the carriage in the first position against the bias of the biasing member.

4. An inertia bullet remover as set forth in claim 3, further comprising a release arranged to release the carriage retainer to permit the biasing member to move the carriage toward the second position.

5. An inertia bullet remover as set forth in claim 4, wherein the biasing member comprises a spring.

6. An inertia bullet remover as set forth in claim 1, wherein the guide comprises a track and the carriage includes at least one follower movable along the track to guide movement of the carriage between the first and second positions.

7. An inertia bullet remover as set forth in claim 6, wherein the track includes a rail along which the at least one follower is movable.

8. An inertia bullet remover as set forth in claim 7, wherein the rail is in tension and applies compression to the frame.

9. An inertia bullet remover as set forth in claim 1, further comprising a carrier for holding the ammunition casing, the carrier being configured to be carried by the carriage between the first and second positions.

10. An inertia bullet remover as set forth in claim 9, wherein at least one of the carrier and the carriage includes a retainer arranged to releasably retain the carrier on the carriage.

11. An inertia bullet remover as set forth in claim 10, wherein the retainer comprises an actuator selectively movable between retaining and non-retaining positions, the actuator when in the retaining position causing the carrier to be releasably retained on the carrier.

12. An inertia bullet remover as set forth in claim 11, wherein the retainer comprises a latch, and the other of the at least one of the carrier and the carriage comprises a keeper arranged to contact the latch in a retaining position of the latch to releasably retain the carrier on the carriage.

13. An inertia bullet remover as set forth in claim 1, wherein the stop surface is arranged to contact the carriage to stop movement of the carriage in the second position.

14. An inertia bullet remover as set forth in claim 1, wherein the carriage driver comprises at least one compression spring arranged to compress responsive to the lever driving movement of the carriage away from the second position toward the first position, the at least one compression spring configured to force the carriage away from the first position toward the second position to cause the stop surface to stop movement of the carriage to cause the bullet via inertia to exit the ammunition casing carried by the cartridge.

15. An inertia bullet remover as set forth in claim 14, wherein the carriage driver comprises a carriage pusher operatively connected to the lever, the carriage pusher being movable with respect to the lever and responsive to movement of the lever in the actuating direction to push the carriage toward the first position away from the second position.

16. An inertia bullet remover as set forth in claim 15, further comprising a linkage operatively connecting the lever to the carriage pusher, the linkage being movable with respect to the lever and the carriage pusher.

17. An inertia bullet remover as set forth in claim 15, further comprising a carriage retainer arranged to retain the carriage in the first position responsive to the carriage arriving to the first position.

18. An inertia bullet remover as set forth in claim 15, wherein the lever is movable in a return direction opposite the actuating direction, and further comprising a carriage retainer arranged to retain the carriage in the first position as the lever is moved in the return direction.

19. An inertia bullet remover as set forth in claim 18, wherein the lever is configured to cause release of the retainer to permit the carriage to move from the first position toward the second position.

20. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet via inertia to exit the ammunition casing carried by the carriage;

wherein the carriage driver comprises an actuator and a linkage, the linkage being movable with respect to the frame and with respect to the actuator to convert movement of the actuator to movement of the carriage toward the first position.

21. An inertia bullet remover as set forth in claim 20, wherein the actuator comprises a lever pivotally connected to the frame.

22. An inertia bullet remover as set forth in claim 20, wherein the carriage driver includes a carriage pusher arranged to push the carriage toward the first position responsive to movement of the actuator.

23. An inertia bullet remover as set forth in claim 20, further comprising a carriage retainer configured to selectively retain the carriage in the first position.

24. An inertia bullet remover as set forth in claim 23, wherein the carriage retainer is configured to automatically retain the carriage in the first position responsive to the carriage moving toward the first position.

25. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet via inertia to exit the ammunition casing carried by the carriage;

a carrier for holding the ammunition casing, the carrier being configured to be carried by the carriage between the first and second positions;

wherein the carrier includes an adjustable ammunition casing holder configured to hold ammunition casings having different sizes.

26. An inertia bullet remover as set forth in claim 25, wherein the ammunition casing holder comprises multiple jaws, at least one of the jaws being movable to adjust a space between the jaws to hold ammunition casings of different sizes therebetween.

27. A method of removing a bullet from an ammunition casing, the method comprising:

moving an actuator with respect to a track and with respect to a carriage carrying the ammunition casing to cause the carriage to move along the track toward a first position away from a second position;

moving the carriage carrying the ammunition casing along the track from the first position to the second position; and stopping movement of the carriage in the second position to cause the bullet to exit the ammunition casing via inertia.

28. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet via inertia to exit the ammunition casing carried by the carriage;

wherein the carriage driver comprises at least one compression spring arranged to compress responsive to movement of the carriage away from the second position toward the first position, the at least one compression spring configured to extend to force the carriage away from the first position toward the second position to cause the stop surface to stop movement of the carriage to cause the bullet via inertia to exit the ammunition casing carried by the cartridge.

29. An inertia bullet remover as set forth in claim 28, further comprising a carriage retainer arranged to retain the carriage in the first position responsive to the carriage arriving to the first position.

30. An inertia bullet remover as set forth in claim 28, wherein the carriage driver comprises an actuator movable in an actuating direction to drive movement of the carriage toward the first position away from the second position, and the actuator is movable in a return direction opposite the actuating direction, and further comprising a carriage retainer arranged to retain the carriage in the first position as the actuator is moved in the return direction.

31. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions, the guide including opposite first and second end portions, the carriage being movable toward the first position by movement along the guide toward the first end portion, the carriage being movable toward the second position by movement along the guide toward the second end portion, the first end portion of the guide being connected to the frame to oppose movement of the first end portion in the direction of the second end portion, the second end portion of the guide being connected to the frame to oppose movement of the second end portion in the direction of the first end portion;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet via inertia to exit the ammunition casing carried by the carriage.

32. An inertia bullet remover as set forth in claim 31, wherein the guide includes a rail, the rail being in tension and applying compression to the frame.

33. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame, the carriage driver including an actuator and a carriage pusher movable with respect to the actuator, the actuator being movable in an actuating direction to drive movement of the carriage pusher to push the carriage away from the second position toward the first position, and the carriage driver being arranged to force the carriage away from the first position toward the second position to cause the stop surface to stop movement of the carriage to cause the bullet via inertia to exit the ammunition casing carried by the carriage.

34. An inertia bullet remover as set forth in claim 33, further comprising a carriage retainer arranged to retain the carriage in the first position responsive to the carriage arriving to the first position.

35. An inertia bullet remover as set forth in claim 33, wherein the actuator is movable in a return direction opposite the actuating direction, and further comprising a carriage retainer arranged to retain the carriage in the first position as the actuator is moved in the return direction.

36. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame, the carriage driver including an actuator movable in an actuating direction to drive movement of the carriage away from the second position toward the first position, the actuator being movable in a return direction opposite the actuating direction, and the carriage driver being arranged to force the carriage away from the first position toward the second position to cause the stop surface to stop movement of the carriage to cause the bullet via inertia to exit the ammunition casing carried by the carriage;

a carriage retainer arranged to retain the carriage in the first position as the actuator is moved in the return direction.

37. An inertia bullet remover as set forth in claim 36, wherein the actuator is configured to cause release of the retainer to permit the carriage to move from the first position toward the second position.

38. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

an ammunition casing carrier configured to hold the ammunition casing, the ammunition casing carrier including an ammunition casing holder, the ammunition casing carrier being removable from the carriage to permit installation of the ammunition casing in the ammunition casing holder, the ammunition casing carrier being configured to be installed on the carriage while the ammunition casing holder holds the ammunition casing;

a guide supported by the frame and arranged to guide movement of the carriage between the first and second positions;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet via inertia to exit the ammunition casing carried by the carriage.

39. An inertia bullet remover as set forth in claim 38, wherein the carriage comprises a keeper and the ammunition casing carrier comprises a retainer selectively engageable with the keeper to retain the ammunition casing carrier on the carriage.

40. An inertia bullet remover for removing a bullet from an ammunition casing, the inertia bullet remover comprising:

a frame;

a carriage configured to carry the ammunition casing, the carriage being supported by the frame and being movable with respect to the frame between a first position and a second position;

a guide supported by the frame and arranged to guide movement of the carriage between the first and second positions;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet via inertia to exit the ammunition casing carried by the carriage;

a tube fitting supported by the frame, the tube fitting arranged to receive the bullet exited from the ammunition casing, the tube fitting configured to connect to a tube for transport of the bullet away from the tube fitting.

41. An inertia bullet remover for removing a bullet and ammunition powder from an ammunition casing, the inertia bullet remover comprising:

a frame;

a carriage configured to carry the ammunition casing, the carriage being supported by the frame and being movable with respect to the frame between a first position and a second position, the carriage including a first follower and a second follower;

a guide supported by the frame and arranged to guide movement of the carriage between the first and second positions, the guide comprising a track including a first rail and a second rail, the first follower of the carriage being moveable along the first rail, and the second follower of the carriage being moveable along the second rail;

a stop surface supported by the frame and arranged to stop movement of the carriage with respect to the frame in the second position;

a carriage driver supported by the frame and arranged to force the carriage away from the first position toward the second position to cause the stop surface to stop movement of the carriage to cause the bullet and ammunition powder via inertia to exit the ammunition casing carried by the carriage.

* * * * *